US008573373B2

(12) United States Patent
Rothschild et al.

(10) Patent No.: US 8,573,373 B2
(45) Date of Patent: Nov. 5, 2013

(54) CONVERTIBLE STORAGE CONTAINER

(75) Inventors: Wayne H Rothschild, Northbrook, IL (US); Kevin McComb, Chicago, IL (US)

(73) Assignee: International Holdings LLC, Northfield, IL (US)

( * ) Notice: Subject to any disclaimer, the term of this patent is extended or adjusted under 35 U.S.C. 154(b) by 59 days.

(21) Appl. No.: 13/237,224

(22) Filed: Sep. 20, 2011

(65) Prior Publication Data

US 2012/0006701 A1 Jan. 12, 2012

Related U.S. Application Data

(63) Continuation of application No. 12/026,550, filed on Feb. 5, 2008, now Pat. No. 8,079,451.

(60) Provisional application No. 60/997,902, filed on Oct. 5, 2007, provisional application No. 60/967,573, filed on Sep. 5, 2007.

(51) Int. Cl.
*A45C 7/00* (2006.01)

(52) U.S. Cl.
USPC ..... 190/107; 190/100; 206/349; 206/372; 383/4; 383/38; 383/6; 383/105; D3/285; D3/302

(58) Field of Classification Search
USPC ..... 190/100, 107, 2; 220/7; 383/4, 38, 6, 383/105; D3/285, 302; 206/349, 372
See application file for complete search history.

(56) References Cited

U.S. PATENT DOCUMENTS

| | | | | |
|---|---|---|---|---|
| 170,991 | A | 12/1875 | Conover | |
| 841,902 | A * | 1/1907 | Shumard | 190/107 |
| 1,269,276 | A | 6/1918 | Harris | |
| 1,365,831 | A | 1/1921 | Hyatt | |
| 1,467,690 | A | 9/1923 | Schwarz | |
| 1,985,111 | A | 12/1934 | Shofer et al. | |
| 2,085,038 | A | 6/1937 | Perreton | |
| 2,105,953 | A | 1/1938 | Quellette | |

(Continued)

FOREIGN PATENT DOCUMENTS

| | | |
|---|---|---|
| GB | 2 368 631 | 5/2002 |
| JP | 3 041693 | 9/1997 |

OTHER PUBLICATIONS

European Search Report, European Application 08795711, dated Jun. 29, 2011, 9 pages.

(Continued)

*Primary Examiner* — Anthony Stashick
*Assistant Examiner* — Cynthia Collado
(74) *Attorney, Agent, or Firm* — Nixon Peabody LLP

(57) ABSTRACT

Apparatuses convertible between at least a storage container in a first configuration and an activity mat in a second configuration. One apparatus includes a circular lid, a circular base, and at least one zipper pull that zips the lid and base to a wall. When zippered, the apparatus has a generally cylindrical shape. A carrying handle is provided on the lid. When unzippered, the apparatus becomes an activity mat and lies flat. Another apparatus includes two sides, a base, a flap, and at least one zipper pull that zips the sides to the flap. The sides resemble the outline of a car, such that the apparatus when zipped up resembles a car and when unzipped becomes an activity mat and lies flat. Backpack straps on the back allow the apparatus to be worn as a backpack.

10 Claims, 20 Drawing Sheets

(56) References Cited

U.S. PATENT DOCUMENTS

| | | | | | |
|---|---|---|---|---|---|
| 2,254,578 | A | * | 9/1941 | O'Brien | 190/107 |
| 2,479,203 | A | | 8/1949 | Brown | |
| 2,636,313 | A | | 4/1953 | Shank | |
| 2,669,641 | A | * | 2/1954 | Becker | 219/387 |
| 2,768,719 | A | | 10/1956 | Samuel | |
| 2,831,624 | A | | 4/1958 | Lever | |
| 3,044,211 | A | | 7/1962 | Palm | |
| 3,097,782 | A | | 7/1963 | Koropatkin et al. | |
| 3,262,283 | A | | 7/1966 | Taylor | |
| 3,295,643 | A | * | 1/1967 | Peterson | 190/119 |
| 3,375,008 | A | | 3/1968 | Atkinson | |
| 3,542,569 | A | | 11/1970 | Farquhar | |
| 3,627,541 | A | | 12/1971 | Farquhar | |
| 3,747,832 | A | | 7/1973 | Chapman | |
| 3,777,862 | A | * | 12/1973 | Zipper | 190/107 |
| 3,976,113 | A | | 8/1976 | Kim | |
| D242,658 | S | * | 12/1976 | Genaro et al. | D3/285 |
| 4,019,675 | A | | 4/1977 | Andersson et al. | |
| 4,091,852 | A | | 5/1978 | Jordan et al. | |
| 4,126,213 | A | | 11/1978 | McDonald | |
| 4,199,097 | A | | 4/1980 | Christenson | |
| 4,206,868 | A | | 6/1980 | Stephens | |
| 4,306,658 | A | | 12/1981 | Montealergre | |
| 4,340,169 | A | | 7/1982 | Webinger | |
| 4,375,111 | A | | 3/1983 | Hall | |
| 4,451,001 | A | | 5/1984 | Webinger | |
| 4,489,815 | A | | 12/1984 | Martinez | |
| 4,661,195 | A | | 4/1987 | Hopson | |
| 4,681,195 | A | | 7/1987 | Trahan et al. | |
| 4,712,673 | A | | 12/1987 | Moore | |
| 4,738,545 | A | | 4/1988 | Westgor | |
| 4,765,533 | A | | 8/1988 | Hoshiko et al. | |
| 4,791,883 | A | | 12/1988 | Lehman et al. | |
| 4,930,680 | A | | 6/1990 | Hanus | |
| 4,984,906 | A | | 1/1991 | Little | |
| 5,016,813 | A | | 5/1991 | Simons | |
| 5,033,668 | A | | 7/1991 | Cohen et al. | |
| 5,035,013 | A | | 7/1991 | Bloom | |
| 5,088,139 | A | | 2/1992 | Bloom | |
| 5,100,151 | A | | 3/1992 | Lyon et al. | |
| D326,560 | S | * | 6/1992 | Schanzer | D3/301 |
| 5,136,738 | A | | 8/1992 | Denson | |
| 5,207,376 | A | | 5/1993 | Cohen et al. | |
| 5,251,460 | A | * | 10/1993 | DeMarco et al. | 62/371 |
| 5,255,841 | A | | 10/1993 | Ritter | |
| 5,294,040 | A | | 3/1994 | Cohen et al. | |
| 5,332,093 | A | * | 7/1994 | Littlepage | 206/457 |
| 5,370,460 | A | | 12/1994 | Nelson | |
| D361,890 | S | | 9/1995 | Littlepage | |
| 5,584,422 | A | | 12/1996 | Bond-Madsen | |
| 5,630,543 | A | | 5/1997 | Dugan | |
| 5,788,350 | A | | 8/1998 | Fladung | |
| 5,853,121 | A | | 12/1998 | Francisco | |
| 5,904,230 | A | | 5/1999 | Peterson | |
| 6,048,249 | A | | 4/2000 | Vandenberg | |
| 6,050,483 | A | | 4/2000 | Haraldsson et al. | |
| 6,053,634 | A | | 4/2000 | Kay | |
| 6,059,179 | A | | 5/2000 | Giampapa | |
| 6,079,616 | A | | 6/2000 | Chinks et al. | |
| 6,146,238 | A | | 11/2000 | Daiber | |
| D435,342 | S | | 12/2000 | Mogil | |
| D435,968 | S | | 1/2001 | Mogil | |
| D436,442 | S | | 1/2001 | Mogil | |
| 6,203,017 | B1 | | 3/2001 | Schultz | |
| 6,247,328 | B1 | | 6/2001 | Mogil | |
| 6,296,094 | B1 | * | 10/2001 | Knecht | 190/107 |
| 6,523,989 | B2 | | 2/2003 | Carty | |
| 6,572,436 | B1 | | 6/2003 | So | |
| 6,604,618 | B1 | * | 8/2003 | Godshaw et al. | 190/107 |
| 6,663,459 | B2 | | 12/2003 | Ostolaza | |
| 6,676,010 | B1 | | 1/2004 | Roseth et al. | |
| 6,736,309 | B1 | | 5/2004 | Westerman et al. | |
| D493,618 | S | | 8/2004 | DeCarlo et al. | |
| D494,758 | S | | 8/2004 | DeCarlo et al. | |
| D500,205 | S | | 12/2004 | DeCarlo et al. | |
| D510,189 | S | | 10/2005 | Greiner | |
| D518,637 | S | | 4/2006 | DeCarlo et al. | |
| 7,044,277 | B2 | * | 5/2006 | Redzisz | 190/107 |
| 7,134,535 | B1 | * | 11/2006 | Horvat | 190/20 |
| 7,143,932 | B2 | | 12/2006 | Wang | |
| 7,153,025 | B1 | * | 12/2006 | Jackson et al. | 383/2 |
| 7,188,713 | B1 | | 3/2007 | Espar et al. | |
| 7,207,426 | B2 | * | 4/2007 | Godshaw et al. | 190/1 |
| 7,278,539 | B2 | * | 10/2007 | Souza | 206/315.1 |
| 7,328,780 | B2 | * | 2/2008 | Hawthorne | 190/107 |
| D619,310 | S | * | 7/2010 | Faulkner | D30/161 |
| 8,079,451 | B2 | * | 12/2011 | Rothschild et al. | 190/107 |
| 2002/0074199 | A1 | * | 6/2002 | Albritton | 190/107 |
| 2003/0042160 | A1 | * | 3/2003 | Godshaw et al. | 206/349 |
| 2003/0057044 | A1 | * | 3/2003 | Hunter | 190/103 |
| 2003/0173171 | A1 | * | 9/2003 | Humiston, Jr. | 190/107 |
| 2003/0221924 | A1 | * | 12/2003 | Tong | 190/107 |
| 2003/0221978 | A1 | * | 12/2003 | Redzisz | 206/278 |
| 2004/0050638 | A1 | * | 3/2004 | Rodrigue et al. | 190/107 |
| 2005/0016808 | A1 | * | 1/2005 | Sapyta | 190/107 |
| 2005/0034948 | A1 | * | 2/2005 | Tiramani | 190/107 |
| 2005/0051404 | A1 | * | 3/2005 | Chi | 190/107 |
| 2005/0183446 | A1 | * | 8/2005 | Fuchs | 62/457.7 |
| 2005/0224304 | A1 | * | 10/2005 | Bhavnani | 190/107 |
| 2006/0118376 | A1 | * | 6/2006 | Godshaw et al. | 190/107 |
| 2006/0169691 | A1 | | 8/2006 | Rothschild et al. | |
| 2006/0177154 | A1 | | 8/2006 | Morrissey | |
| 2006/0266603 | A1 | * | 11/2006 | Godshaw et al. | 190/108 |
| 2007/0074941 | A1 | * | 4/2007 | Liang | 190/107 |
| 2009/0127045 | A1 | * | 5/2009 | Williams et al. | 190/107 |
| 2009/0145711 | A1 | * | 6/2009 | Panosian et al. | 190/107 |

OTHER PUBLICATIONS

Foldable Storage Box Small Grey at dwell. Downloaded Jun. 22, 2007 at http://dwell.co.uk/product.php?prod=102584.

Information brochure from Homegrown Kids—Activity Cooler www.toydirectory.com/monthly/toyfairpreview/Homegrown/index.asp; 1 page.

Information brochure from Homegrown Kids—Toy Taco www.toydirectory.com/monthly/toyfairpreview/Homegrown/index.asp; 1 page.

Information brochure from Parents of Innovation—Romp'n Run www.parentsofinvention.com/home.html; 1 page.

Information brochure from Venio Valet Tray—Valet Tray http://www.worldlux.com.gci/?field0=Valet%20Tray&dept=LEATH&collect; 1 page.

International Search Report corresponding to co-pending International Patent Application Serial No. PCT/US2008//010272, European Patent Office, dated Dec. 9, 2008, 2 pages.

Photo image from Parentsoup—Manicure Lap Desk www.parentsoup.com/specialevents/holiday2004/photo/0..654798.655903.00.html; 1 page.

Photographs of packaging and product—Marshmallow—Create-A-Room—School Bus Autobus; (Apr. 2005); 9 pages.

Photographs of packaging and product—Worlds Apart—Ready Room™ Collection—Pack & Playmates Truck; (Apr. 2005); 8 pages.

Photographs of packaging and product—Worlds Apart—Ready Room™ Collection—Pack & Playmates Cottage; (Apr. 2005); 18 pages.

Photographs of packaging and product—Worlds Apart—Ready Room™ Fold-away soft storage—Pack & Playmates Fire Truck; (Apr. 2005); 11 pages.

Product Information Sheet for Clink-Proof 6-Pack Wetsuit: Flat Lunch Pack Tote; Herrington Catalog.com, "Wetsuit for 6-Packs Gives You a Clink-Proof Way to BYOB!" 2 pages (printed from the Internet on Dec. 6, 2005).

Toys Et Cetera Fall 2005 Catalog Description of a Play Mat (printed from the Internet on Oct. 4, 2005); 1 page.

Written Opinion corresponding to co-pending International Patent Application Serial No. PCT/US2008/010272, European Patent Office, dated Dec. 9, 2008, 6 pages.

* cited by examiner

CONVERTIBLE STORAGE CONTAINER

CROSS-REFERENCE TO RELATED APPLICATION

This application is a continuation of application Ser. No. 12/026,550, filed Feb. 5, 2008, now allowed, which claims the benefit of U.S. Provisional Application No. 60/997,902, filed Oct. 5, 2007, and U.S. Provisional Application No. 60/967,573, filed Sep. 5, 2007, each of which is incorporated by reference herein in its entirety entireties. This application is related to U.S. patent application Ser. No. 11/263,424, titled "Multipurpose Storage Device and Method," filed Oct. 31, 2005, which is incorporated herein by reference in its entirety.

BACKGROUND OF THE INVENTION

Children love to play with their toys, but they don't like to clean them up. Children also like to take their toys on the go. What is needed is a simple solution to play, clean-up and on the go fun.

SUMMARY OF THE INVENTION

According to certain embodiments, an apparatus convertible between at least a storage container in a first configuration and an activity mat in a second configuration includes a generally circular lid having zipper teeth arranged about a periphery of the lid, a generally circular base having zipper teeth arranged about a periphery of the base, and at least one zipper pull. The apparatus further includes a wall. The wall has zipper teeth arranged to mate with corresponding ones of the zipper teeth of the lid and the zipper teeth of the base such that when the lid and the base are zippered to the wall via the at least one zipper pull in the first configuration, the apparatus has a generally cylindrical shape. The lid and the base may be unzippered from the wall such that the apparatus can lie substantially flat in the second configuration.

According to certain embodiments, an apparatus convertible between at least a storage container in a first configuration and an activity mat in a second configuration includes, a base portion, at least two side portions connected to the base portion, a lid flap portion connected to the base adjacent the at least two side portions, and at least two zipper pulls. Each of the two sides have first zipper teeth and the lid flap portion has second zipper teeth. The two zipper pulls are configured to zip and unzip the lid flap portion to and from the at least two side portions such that when the lid flap portion is substantially zippered to the at least two sides, the apparatus is in the first configuration. The first zipper teeth follow a generally curved path comprising a first positively oriented curved path portion and a second negatively oriented curved path portion.

According to certain embodiments, an apparatus convertible between at least a storage container in a first configuration and an activity mat in a second configuration includes, a generally circular lid having zipper teeth arranged about a periphery of the lid, a generally circular base having zipper teeth arranged about a periphery of the base, a generally rectangular wall having zipper teeth arranged about a periphery of the wall, and a zipper pull. The zipper pull is configured to releasably secure the zipper teeth of the base with the corresponding zipper teeth of the wall. The zipper pull is further configured to releasably secure a portion of the zipper teeth of the wall along a first side of the wall with a corresponding portion of zipper teeth of the wall along a second opposing side of the wall. The zipper pull is further configured to releasably secure the zipper teeth of the lid with the corresponding zipper teeth of the wall such that when the lid and the base are zippered to the wall, the apparatus is in the first configuration having a generally cylindrical shape. The lid and the base may be unzippered from the wall such that the apparatus can lie substantially flat in the second configuration.

Aspects of the invention include a storage container that unzips into an activity mat. When the container is zipped up, it becomes a storage container for capturing items back into the storage container.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
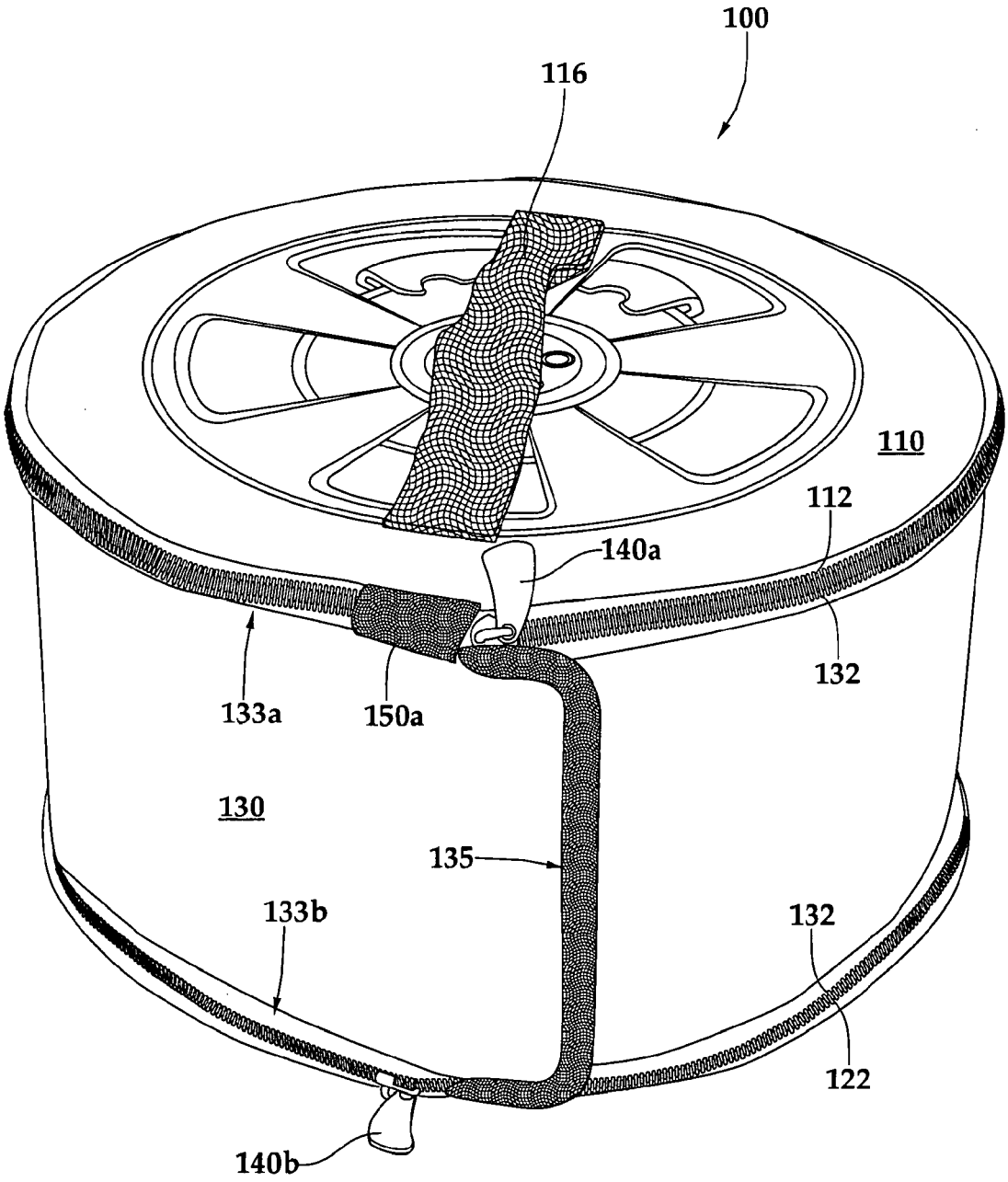
FIG. 1 is a perspective view of a convertible container in a storage container configuration according to certain embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

When children travel with their toys, they often lose them or do not have a place to play with their toys at their destination. An innovative convertible toy container that unzips and converts to an activity mat (e.g. play mat) provides children with both a way to carry their toys and a place to play. Decorating this convertible container (e.g. storage container) in the theme of toys (e.g., car, model runway, automobile themes, truck, race track) makes the container even more attractive and fun for the children. Cleaning up toys is also inconvenient and causes unwanted discussions between caregivers and children. To this end, the activity mat can be zipped up into the container and collect the toys in the process, thereby eliminating the need for these discussions. The container can take the shape of, for example, a circular box, a square box, a rectangular box, a car, a truck, a log, a car wheel, etc. It is contemplated that the convertible container can be formed in various other shapes in accordance with the present disclosure. The container can be made of any material including, but not limited to, cotton, canvas, hemp, nylon, polyester, or similar materials or combinations thereof. The inner stiffening material that provides rigidity to the structures of the container can be made of any sturdy or semi-rigid material such as cardboard, paperboard, plastic, foam, PVC, or other material known in the art. Optional padding may further line the interior of the container, and may include material composed of foam, wadding, or other materials known in the art.

The decoration of the inside and the outside of the activity mat can be by embroidery, sewing on fabric accessories. The decoration can also be made with silk screening, rotogravure, heat transfer, painting or other methods of decoration known in the art.

Referring to FIGS. 1-4, according to certain embodiments, an apparatus convertible between a storage container and an activity mat, also referred to as a convertible container 100, is depicted in the general shape of a hat-box, as shown in FIG. 1. The convertible container 100 includes a generally circular lid 110 (which may be oval, round), a generally circular base 120, a wall 130, and two zipper pulls 140*a,b*. Both the lid 110 and the base 120 have zipper teeth 112, 122 arranged about their respective peripheries. The wall 130 has zipper teeth 132 arranged to mate with the corresponding zipper teeth 112 and 122 on the lid 110 and on the base 120, respectively. According to certain embodiments, as shown in FIG. 1, the two zipper pulls 140*a,b* are adapted to removably connect the zipper teeth 132 on the wall 130 with the corresponding zipper teeth 112 and 122 on the lid 110 and on the base 120, respectively, such that the lid 110 and the base 120 are zippered to the wall 130 in the storage container configuration.

The wall 130 has a generally rectangular shape having two opposing longer edges 133 and two opposing shorter edges 135. The convertible container 100 is shown as a generally cylindrical shape; however, it is contemplated that in certain embodiments a convertible container can be of a variety of shapes including, but not limited to, a circular box, a square box, a rectangular box, a car, a truck, a car wheel, etc.

Figure 2:
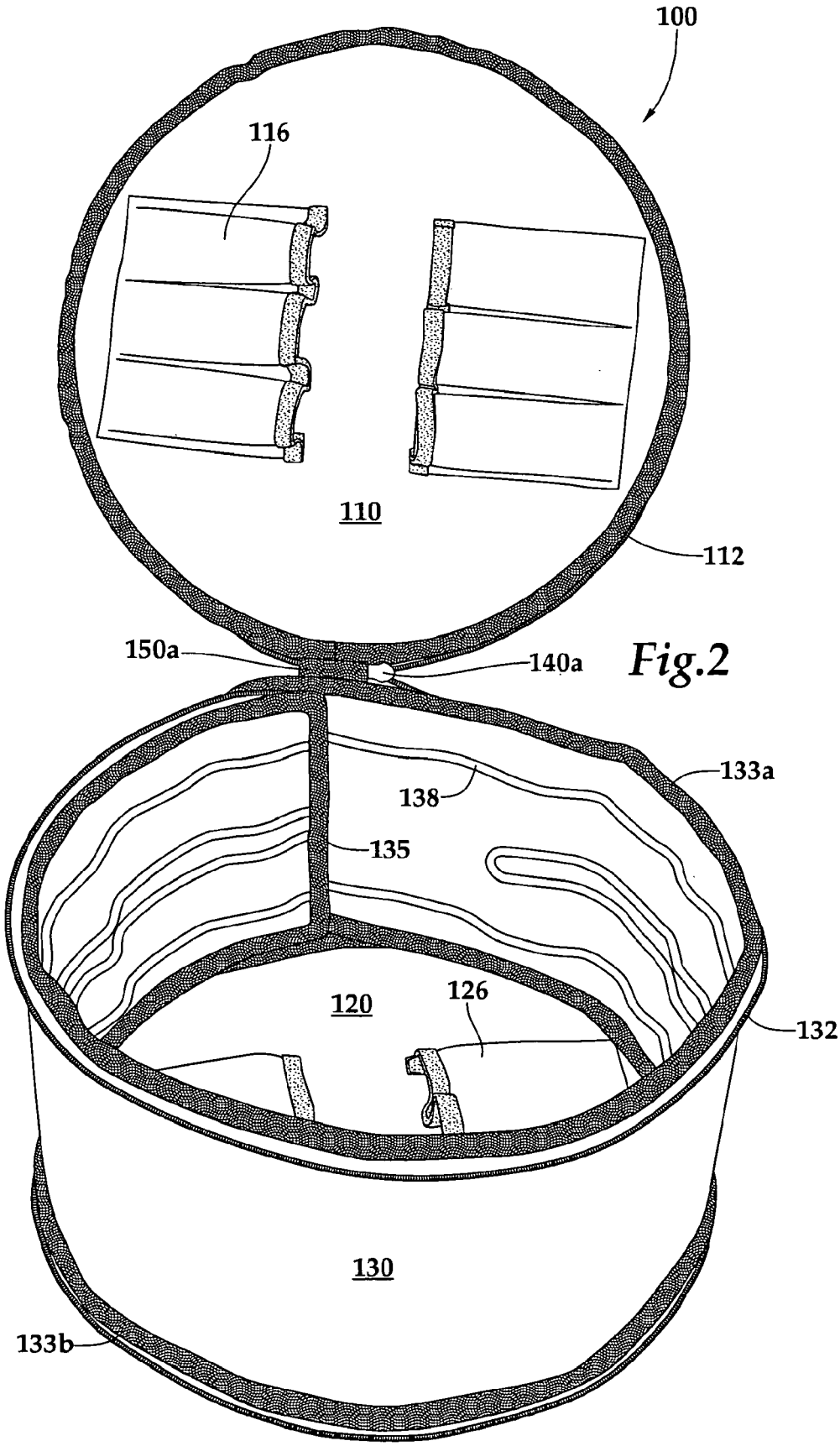
FIG. 2 is a perspective view of the convertible container of FIG. 1 with the lid in an open position.

Referring to FIG. 2, the convertible container 100 of FIG. 1 is shown with the lid 110 unzipped in an open, flattened configuration, also called an activity mat configuration. The lid 110 can be unzipped for access to toys and other household goods stored within the convertible container 100. Storage pockets 116 and 126 are attached to an interior portion of the lid 110 and the base 120, respectively. The storage pockets 116 and 126 can be used to store and/or organize toys or household goods (e.g. cars, dolls, crayons, figurines, etc.) and further to prevent the toys from shifting around and breaking when transporting the convertible container 100. It is contemplated that in certain embodiments a convertible storage container 100 is provided with only storage pockets on a lid or on a base. It is also contemplated a convertible container is provided without any storage pockets, or alternatively storage pockets may be formed on an interior or exterior surface of a wall. According to certain embodiments, a raised track 138 is attached to an interior portion of the wall 130. The raised track 138 may be used as a race track for racing cars when the convertible container 100 is arranged in the activity mat configuration, shown in FIGS. 3 and 4. It is contemplated that in certain embodiments, additional tracks and/or convertible containers may be adaptable to attach to the activity mat to extend the raised race track 138.

Figure 3:
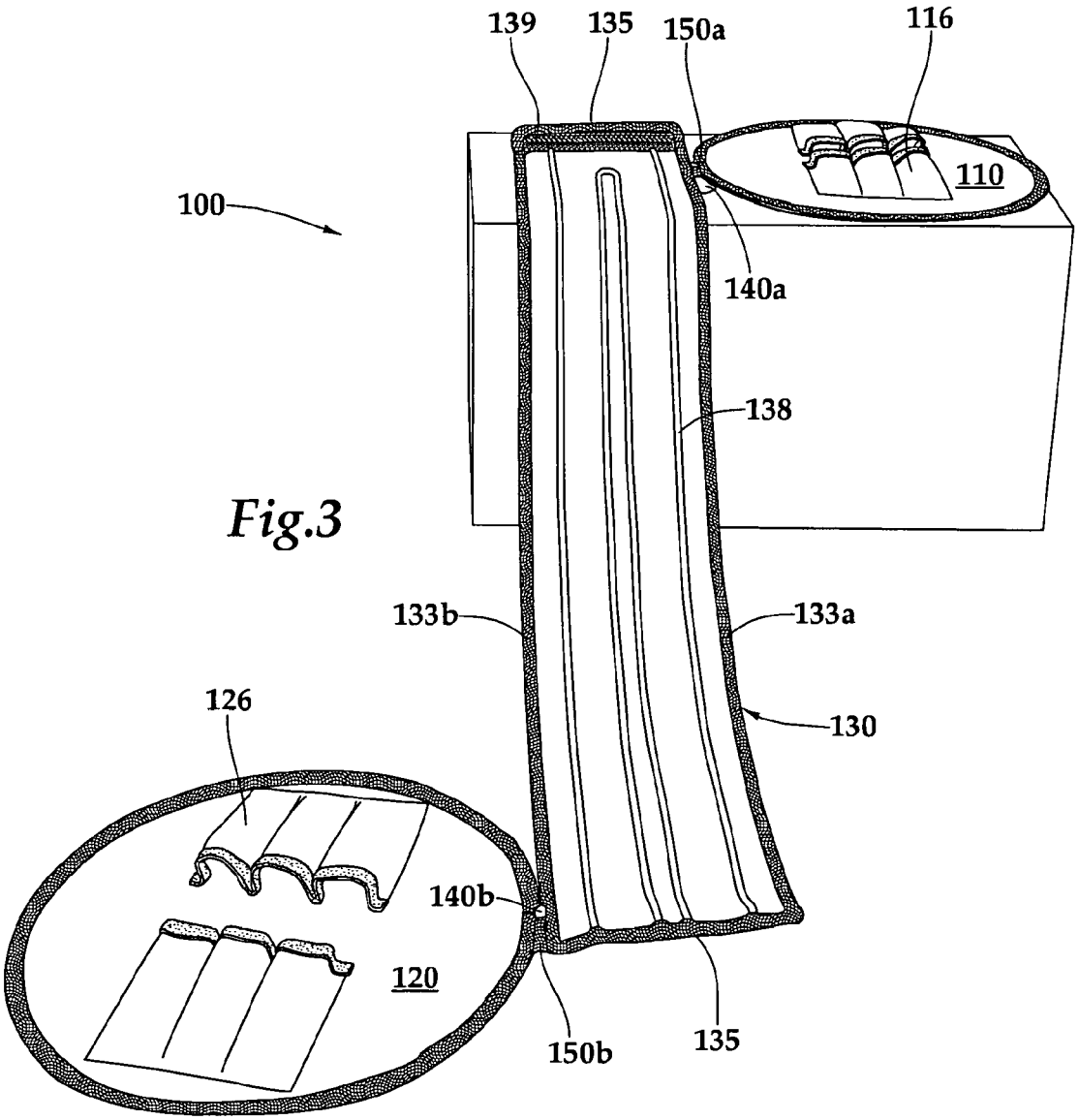
FIG. 3 is a perspective view of the convertible container of FIG. 1 in an activity mat configuration having a portion of the activity mat in a raised position.
Figure 4:
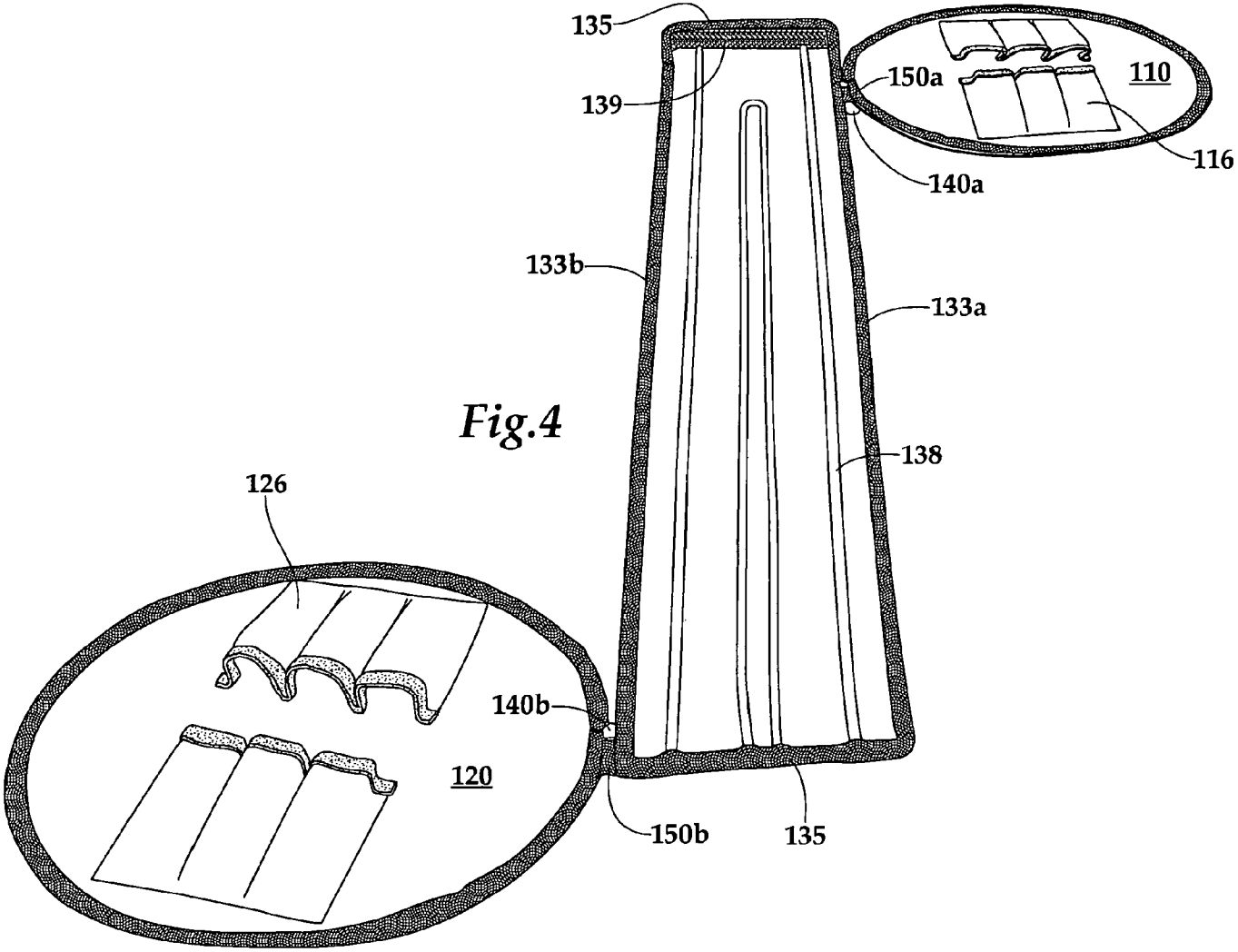
FIG. 4 is a perspective view of the convertible container of FIG. 1 in an activity mat configuration laying substantially flat.

Referring to FIGS. 3 and 4, the convertible container 100 of FIGS. 1 and 2 is shown in the activity mat configuration. According to certain embodiments, when the lid 110 and the base 120 are unzippered from the wall 130, the convertible container 100 can lie substantially flat as an activity mat, as shown in FIG. 4. The inner surfaces of the lid 110, the base 120, and the wall 130 form an activity mat surface. The activity mat 100 may be decorated with a theme appropriate for a suggested usage of the convertible container 100. For example, a child may use the convertible container 100 to store dolls, and so a dollhouse theme with a model runway can be decorated on the inner surfaces of the convertible container 100. For another example, a child may use the convertible container 100 to store toy cars and trucks, and so a race track theme including racing tracks may be decorated or incorporated on the inner surfaces of the convertible container 100. FIG. 3 depicts one example of how the convertible container 100, in the activity mat configuration, may be setup to form a race track having an integrated slope. A child may easily set one end of the wall 130 and the lid 100 or the base 120 on top of a box or chest to create a fun and exciting sloped track for racing cars.

In certain embodiments, the convertible container of FIGS. 1-4 also includes a first and a second attachment member 150*a,b*. The first attachment member 150*a* permanently connects the lid 110 to the wall 130 (e.g., by stitching, glue, or the like). The second attachment member 150*b* permanently connects the base 120 to the wall 130. The attachment members 150*a,b* generally connect the lid 110 and the base 120 tangentially to the wall 130. The attachment members 150*a,b* have a generally rectangular shape and can be made from any material including, but not limited to, cotton, canvas, hemp, nylon, polyester, polypropylene, or similar materials or combinations thereof. The attachment members 150*a,b* can have a length between four inches and a quarter of an inch. Desirably, the attachment members 150*a,b* have a length between two inches and one inch. The attachment members 150*a,b* can have a width between a tenth of an inch and one inch. Desirably, the attachment members 150*a,b* have a width between a quarter of an inch and one inch. It is contemplated that in certain embodiments, the lid 110 and/or the base 120 are not attached to the wall 130 by an attachment member such that the lid 110 and/or the base 120 may be completely detached from the wall 130 when unzippered therefrom.

Figure 6:
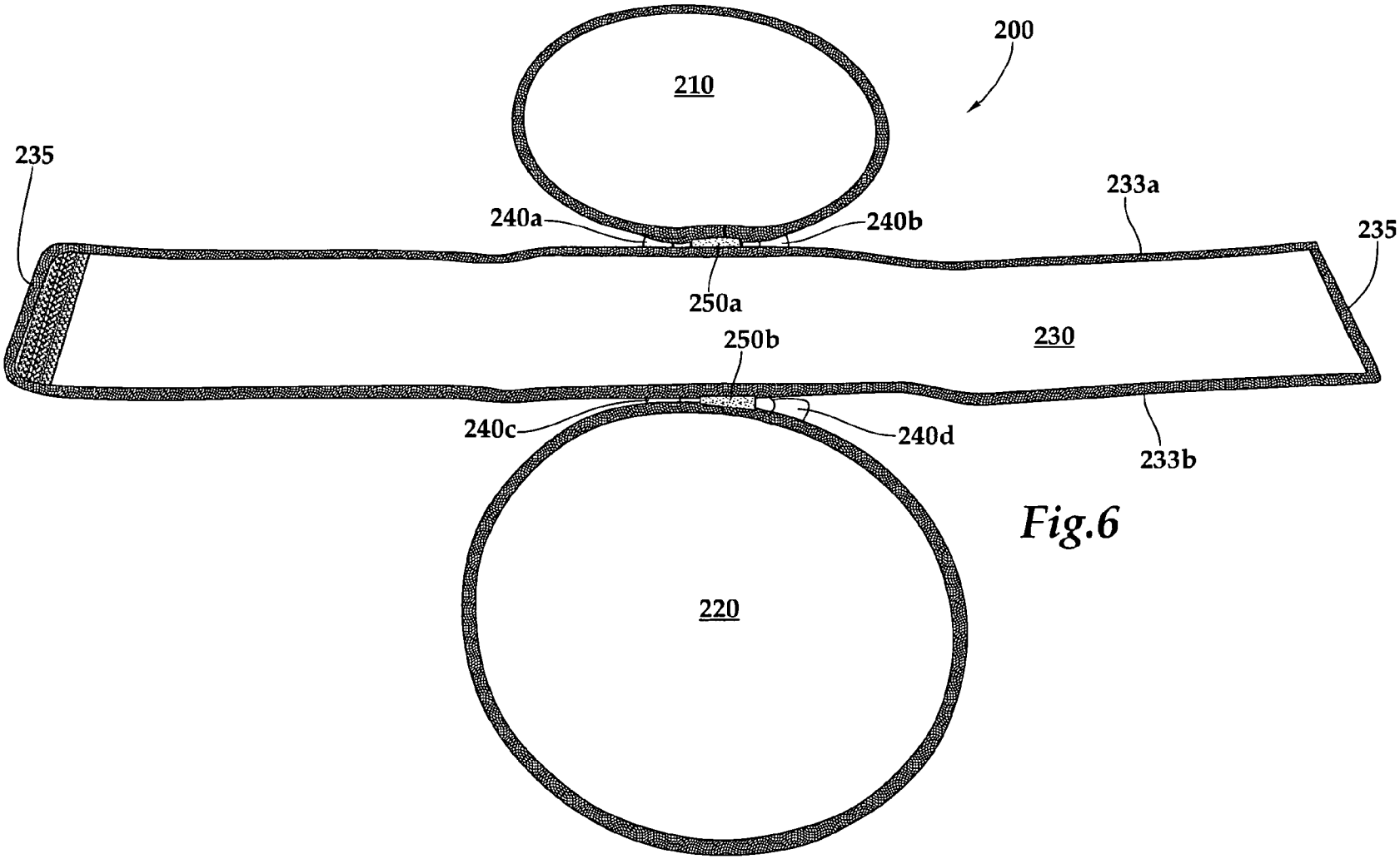
FIG. 6 is a perspective view of the convertible container of FIG. 5 in an activity mat configuration laying substantially flat.

Referring to FIG. 4, according to certain embodiments, the convertible container 100 includes the first attachment member 150*a* to connect the lid 110 to one of the two opposing longer edges 133*a* of the wall 130 and the second attachment member 150*b* to connect the base 120 to the other opposing longer edge 133*b* of the wall. The lid 110 and the base 120 are attached to the wall such that they resemble a percent sign (%) configuration. It is contemplated that in certain embodiments, the lid 110 and the base 120 can be attached to the wall 130 at different locations along the two opposing longer edges 133*a, b*. For example, as depicted in FIG. 6, the lid 210 and the base 220 can be connected to the wall 230 at substantially the same point on the two opposing longer edges 233*a,b* of the wall 230. It is further contemplated that the lid 210 and the base 220 can be connected at a middle portion of the two opposing longer edges 233*a,b* of the wall or the lid 210 and the base 220 can be connected near the same or opposing shorter edges 235 of the wall 230.

Referring back to FIGS. 1-4, the zipper pulls 140*a* and 140*b* can be configured to zip and unzip in the opposite directions relative to one another (i.e. one clockwise and the other counterclockwise). It is contemplated that in certain embodiments, the zipper pulls 140*a,b* can be configured to zip and unzip in the same direction (i.e. both clockwise or both counterclockwise).

According to certain embodiments, one of the two opposing shorter edges 135 of the wall 130 substantially overlaps the other opposing shorter edge 135 of the wall 130. The wall 130 can also include hook fasteners 139 near one of the two opposing shorter edges 135 of the wall 130 and loop fasteners on the other opposing shorter edge 135 of the wall 130. The hook and look fasteners (e.g. VELCRO®) are removably attachable to one another. When the two zipper pulls 140*a,b* urge the activity mat into the convertible container 100 configuration, the one of the two opposing shorter edges 135 containing the loop fasteners 139 is also urged to overlap the other opposing shorter edge 135 containing the hook fasteners 139, thereby removably attaching the wall 130 to itself Note that the length of the wall 130 is at least equal to the circumference of the lid 110. To allow for the overlapping attachment mechanisms, such as the hook and loop fasteners, the length of the wall 130 is longer than the circumference of the lid 110. The lid 110 and the base 120 have substantially the same dimensions such that when the convertible container 100 is in a folded configuration (as shown in FIG. 1), the convertible container 100 has a generally cylindrical shape. Sometimes, this shape is referred to herein as a "hat box" shape.

According to certain embodiments, the convertible container 100 can also include a handle 116, as shown in FIG. 1. It is contemplated that the handle 116 can be attached to the lid 110, the base 120, or the wall 130. The handle 116 can be made of any material including, but not limited to, cotton, canvas, hemp, nylon, polyester, or similar materials or combinations thereof. The user grasps the handle 116 for conveniently carrying the convertible container 100.

According to certain embodiments a convertible container includes a lid, a base, a wall, and at least one zipper. Note that the lid, base, and wall may be formed of an integral piece of material, and the designations simply refer to those portions of the material that correspond to a lid, a base, and a wall. Alternately, any combination of the lid, base, and wall may be separate pieces attached together by, for example, stitching, glue, or other techniques well known in the art. When the convertible container is in the zippered-up, folded configuration (such as shown in FIG. 1), the convertible container resembles a wheel and may decorated accordingly complete with tread marks on the wall and a hubcap and brake pad on the lid to complete the theme. The lid 202 can include a convenient handle for transporting the wheel-themed convertible container. Zipper pulls and zipper teeth are included and attached just like in the convertible container 100 described above. Hook and loop fasteners are attached to the ends of the wall to fasten the ends when the base or the lid is zippered to the wall.

Figure 5:
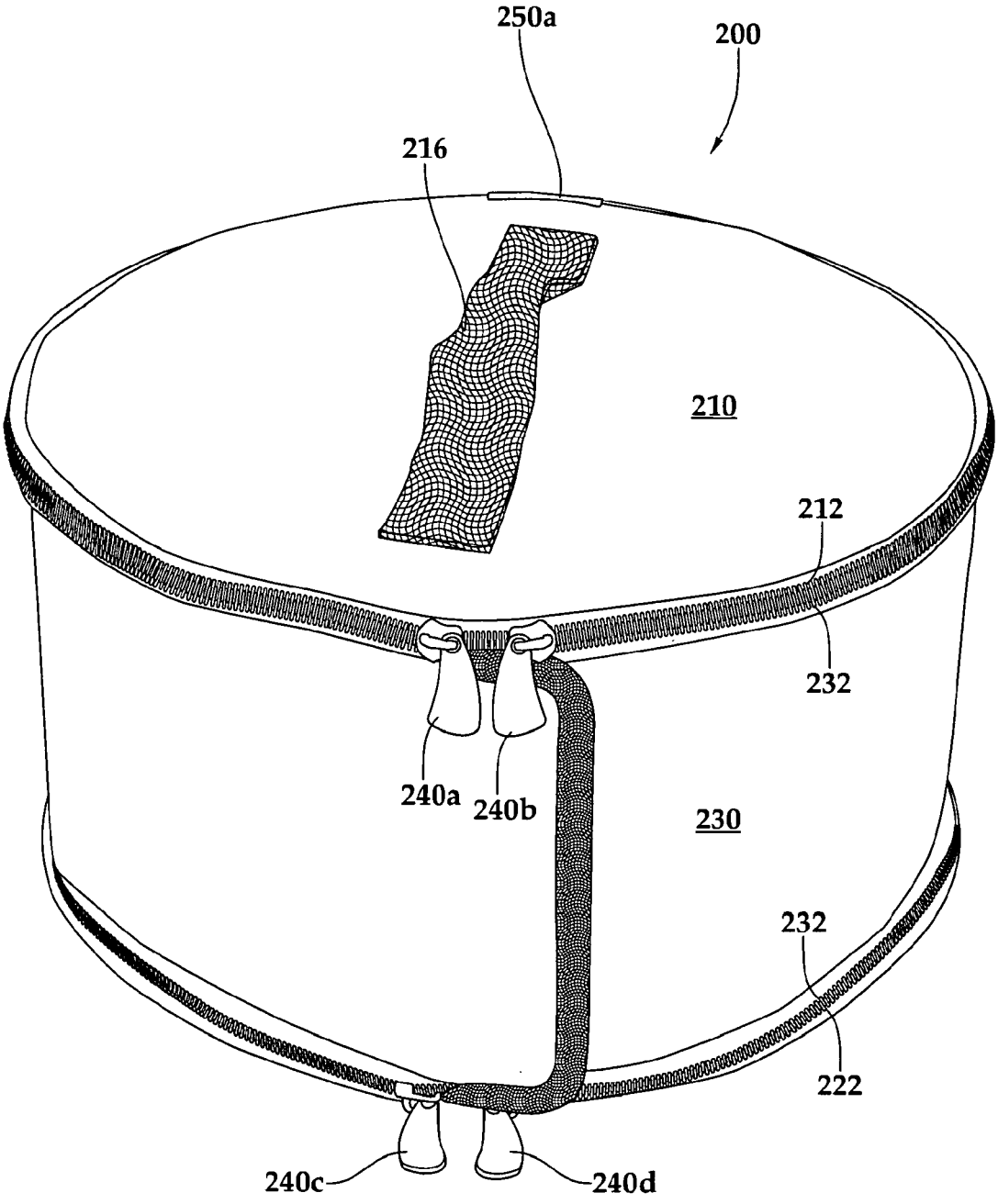
FIG. 5 is a perspective view of a convertible container in a storage container configuration having four zipper pulls, according to certain embodiments of the present disclosure.

Referring to FIGS. 5-6, according to certain embodiments, an apparatus convertible between a storage container and an activity mat, also referred to as a convertible container 200, is depicted in the shape of a hat-box, as shown in FIG. 5. The convertible container 200 is similar to the convertible container 100 shown in FIGS. 1-4 and described above in that the convertible container 200 includes a lid 210, a base 220, and a wall 230; however, the convertible container 200 also includes four zipper pulls 240*a,b,c,d* as compared to the two zipper pulls 140*a,b* included in the convertible container 100. The four zipper pulls 240*a,b,c,d* are adapted to removably connect zipper teeth 232 on the wall 230 with corresponding zipper teeth 212 and 222 on the lid 210 and on the base 220, respectively, such that the lid 210 and the base 220 are zippered to the wall 230 in the storage container configuration. The lid 210 has two zipper pulls 240*a,b* and the base 220 has the other two zipper pulls 240*c,d*. The convertible storage container 200 can further include a handle 216 that is attached to lid 210 as shown, or alternatively, a handle can be attached to either the base 220, the wall 230.

Referring to FIG. 6, the convertible container 200 of FIG. 5 is shown in the unzippered activity mat configuration. The activity mat configuration of convertible container 200, as shown in FIG. 6, resembles a mathematical divide sign, where the lid 210 and the base 220 are permanently attached via attachment members 250*a,b* near the center portion of the wall 230.

Figure 7:
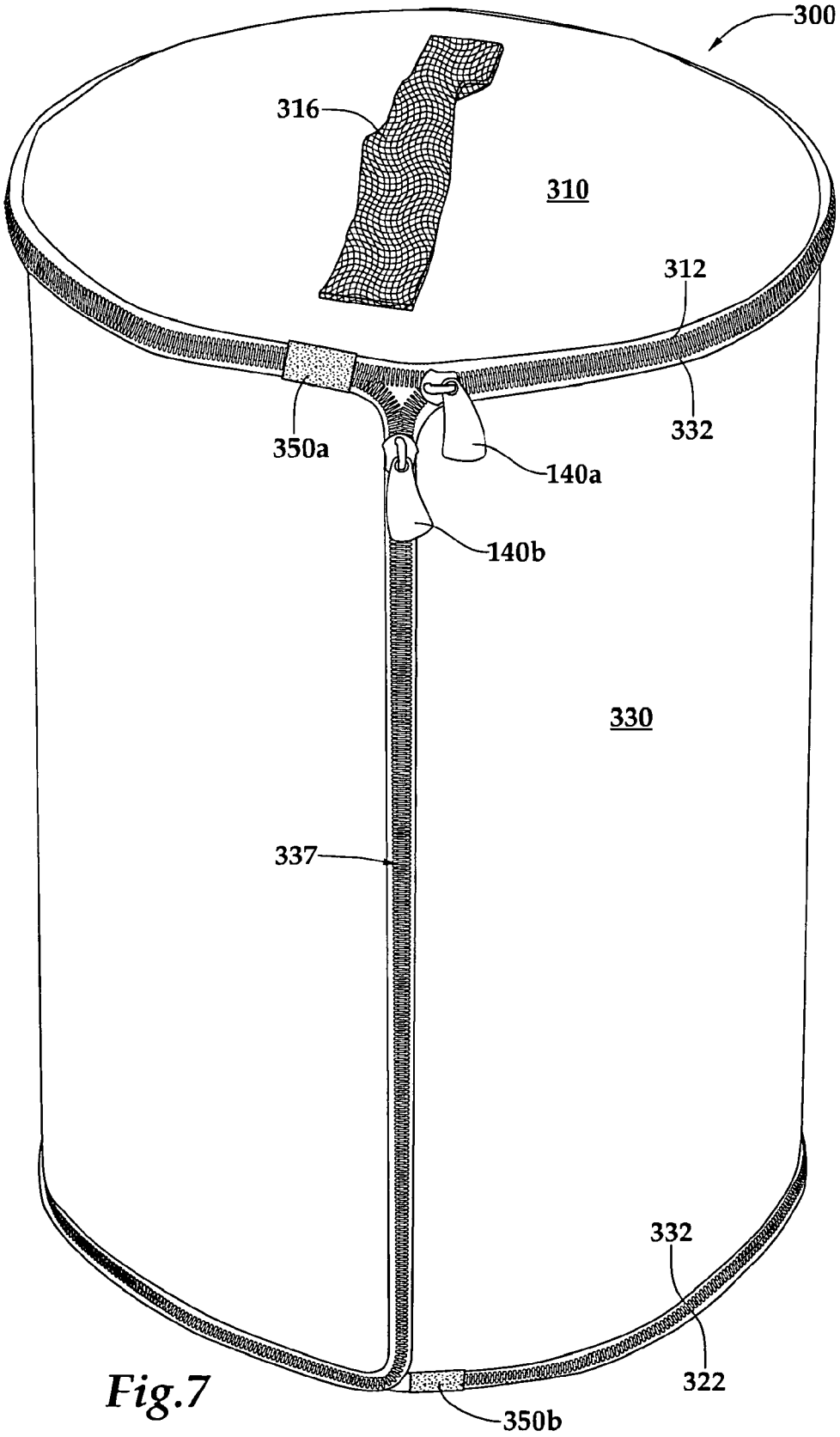
FIG. 7 is a perspective view of a convertible container in a storage container configuration, according to certain embodiments of the present disclosure.
Figure 8:
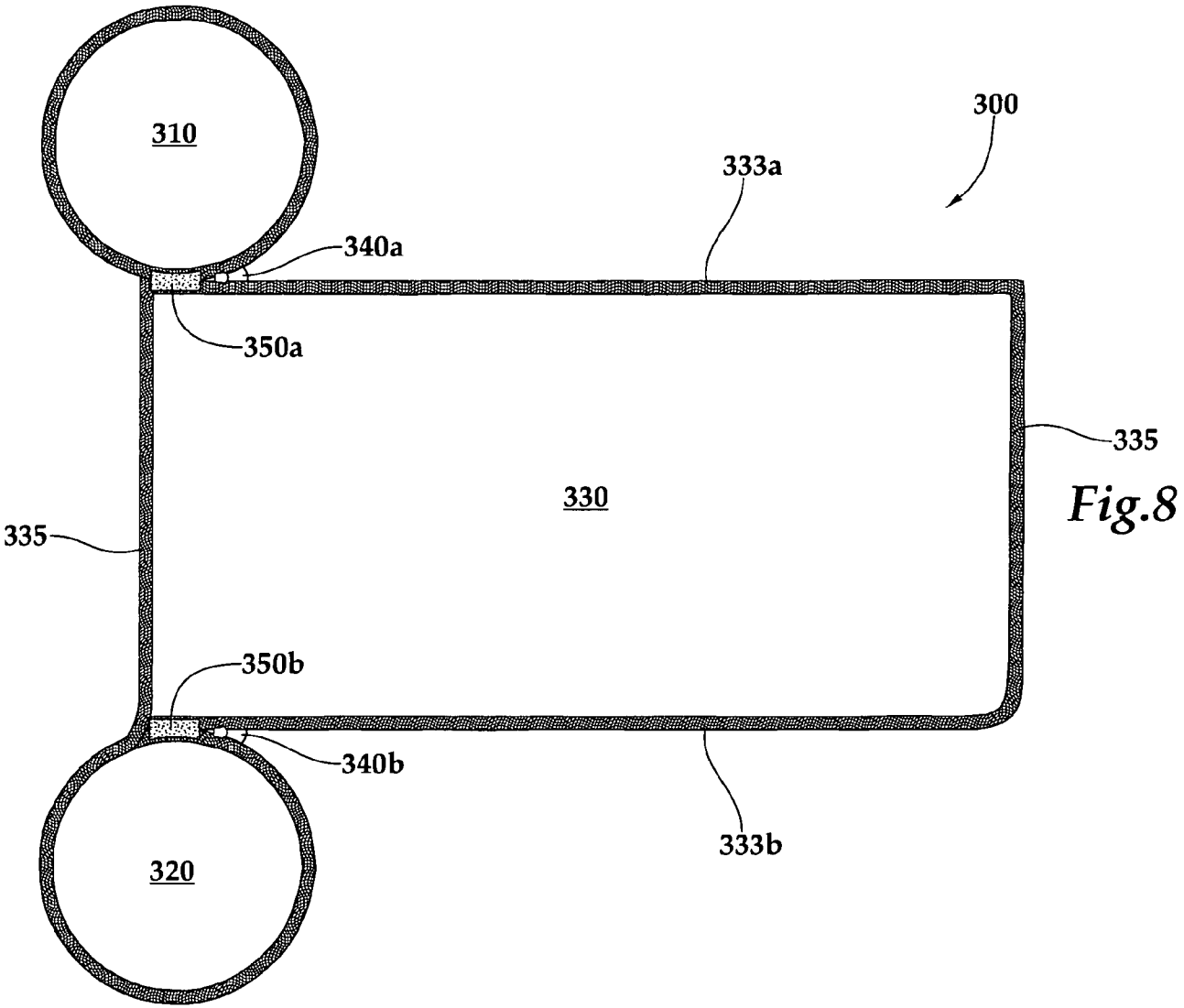
FIG. 8 is a perspective view of the convertible container of FIG. 7 in an activity mat configuration laying substantially flat.

Referring to FIGS. 7 and 8, according to certain embodiments, an apparatus convertible between a storage container and an activity mat, also referred to as a convertible container 300, is depicted in the shape of an elongated cylinder, as shown in FIG. 7. The convertible container 300 is similar to the convertible container 100 shown in FIGS. 1-4 and described above in that the convertible container 300 includes a lid 310, a base 320, a wall 330, and two zipper pulls 340*a,b*. The zipper pulls 340*a,b*, are configured to removably connect zipper teeth 332 on the wall 330 with corresponding zipper teeth 312 and 322 on the lid 310 and on the base 320, respectively, such that the lid 310 and the base 320 are zippered to the wall 330 in the storage container configuration. However, the zipper pull 340*b* is also configured to removably connect zipper teeth 337 that run along each of the two opposing shorter edges 335 of the wall 330. The ability of the zipper pull 340*b* to additionally connect the two opposing shorter edges 335 of the wall 330 eliminates the need for overlapping wall edges and Velcro type fasteners described above in relation to the convertible containers 100 and 200. The convertible storage container 300 can further include a handle 316 that is attached to lid 310 as shown in FIG. 7, or alternatively, a handle can be attached to either the base 320, the wall 330.

Referring to FIG. 8, the convertible container 300 of FIG. 7 is shown in the unzippered activity mat configuration. The lid 310 and the base 320 are permanently attached via attachment members 350*a,b* near one of the two opposing shorter edges 335 of the wall 330.

Figure 9:
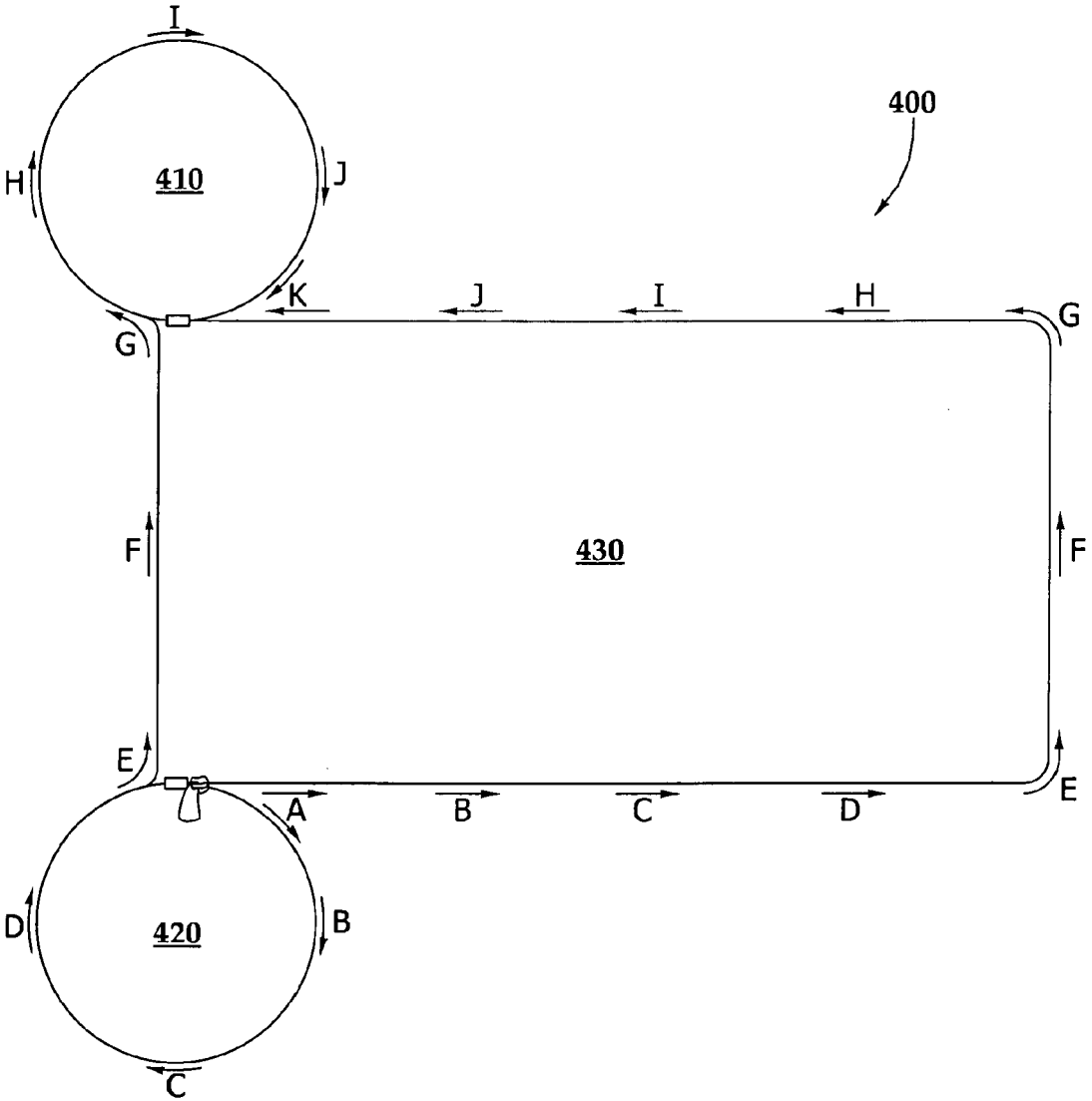
FIG. 9 is a diagram showing the zipper pull path of a single zipper convertible container according to certain embodiments of the present disclosure.

Referring to FIG. 9, a schematic example of a convertible container 400 is shown in the activity mat configuration. The convertible container 400 is similar to the convertible container 300, but the convertible container 400 only includes one zipper pull 440 that is configured to zip and unzip all of the zipper teeth arranged around a lid 410, a base 420, and a wall 430 to transform the convertible container 400 between the activity mat configuration and the storage container configuration. The arrows A-K indicate an exemplary path that the zipper pull 440 takes to completely transform the activity mat configuration to the storage container configuration.

Figure 10:
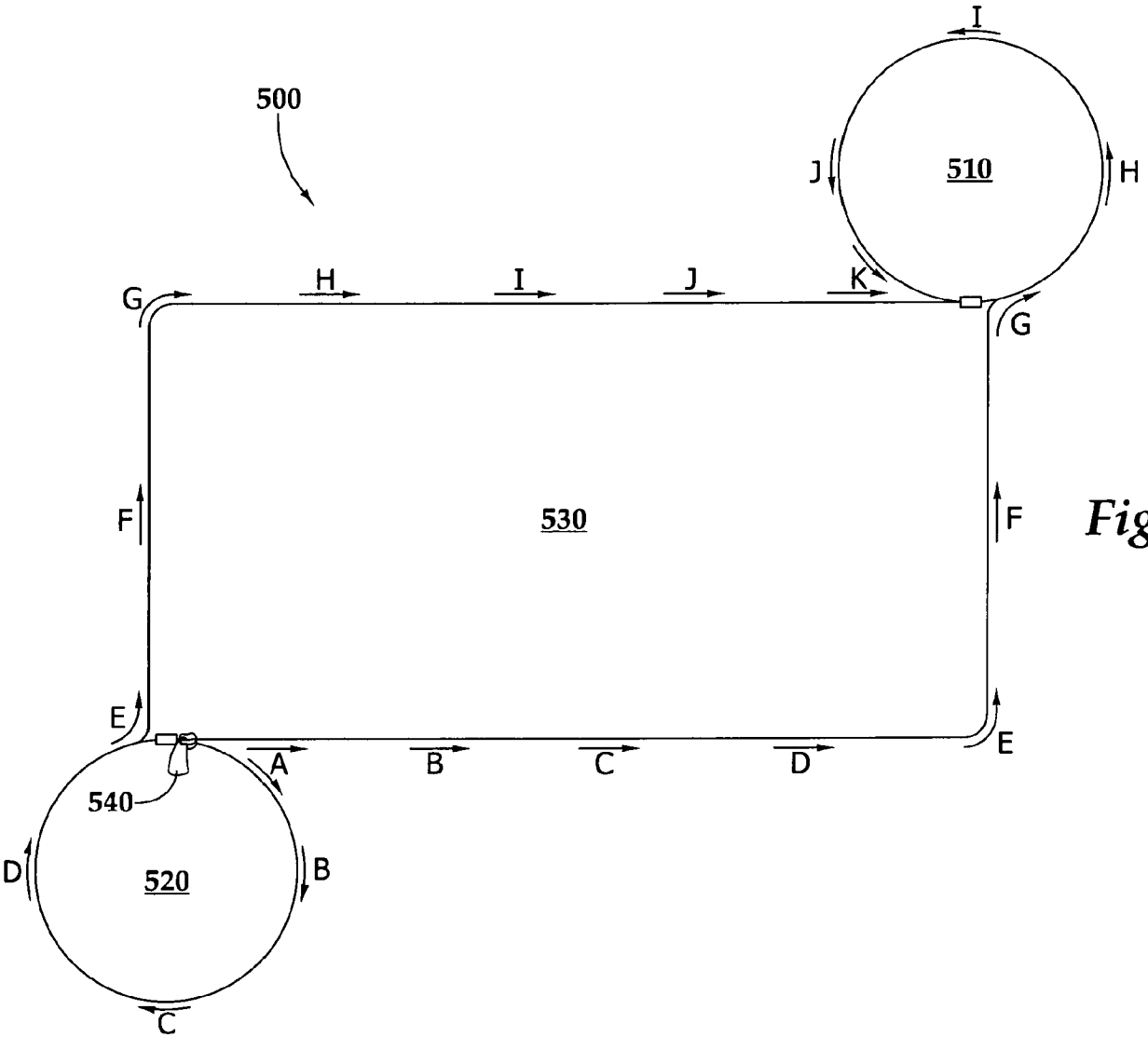
FIG. 10 is a diagram showing the zipper pull path of another single zipper convertible container according to certain embodiments of the present disclosure.

Referring to FIG. 10, a schematic example of a convertible container 500 is shown in the activity mat configuration. The convertible container 500 is similar to the convertible container 100 and 300, but the convertible container 500 only includes one zipper pull 540 that is configured to zip and unzip all of the zipper teeth arranged around a lid 510, a base 520, and a wall 530 to transform the convertible container 500 between the activity mat configuration and the storage container configuration. The arrows A-K indicate an exemplary path that the zipper pull 540 takes to completely transform the activity mat configuration to the storage container configuration. Thus, a convertible container may only include one zipper pull in either a percent sign configuration (e.g., container 500) or a configuration shown in FIG. 9 (e.g., container 400).

Referring to FIGS. 11-20, according to certain embodiments a convertible container 600 is shown. The convertible container 600 is adapted to transform between a storage container configuration and an activity mat configuration. The convertible container 600 includes a base portion 610, two side portions 630, a lid flap 620, and two zipper pulls 640. The two side portions 630 are connected to the base portion 610. Each of the two side portions 630 has zipper teeth 612. The side portions 630 are generally symmetrical, but it is contemplated that the side portions 630 can be asymmetrical. The lid flap portion 620 is connected to the base portion 610 and is adjacent to the two side portions 630. The lid flap portion 620 also has zipper teeth 612 The two zipper pulls 640 are configured to zip and unzip the lid flap portion 620 to and from the two side portions 630. As mentioned above, the base portion 610, side portions 630, and lid flap 620 may be formed integrally of a single piece of material, with the various portions delineated by stitching or seams as shown by the dashed lines in FIG. 14, for example. The stitching facilitates the folding of the side portions 630 relative to the base portion 610 such that they can be easily erected when transforming the convertible container 600 between activity mat configuration and storage container configuration. Alternately, any combination of the base portion 610, side portions 630, and lid flap 620 may be formed as separate pieces of materials and then joined by stitching, gluing, or other techniques well known in the art for attaching pieces of materials together.

Figure 14:
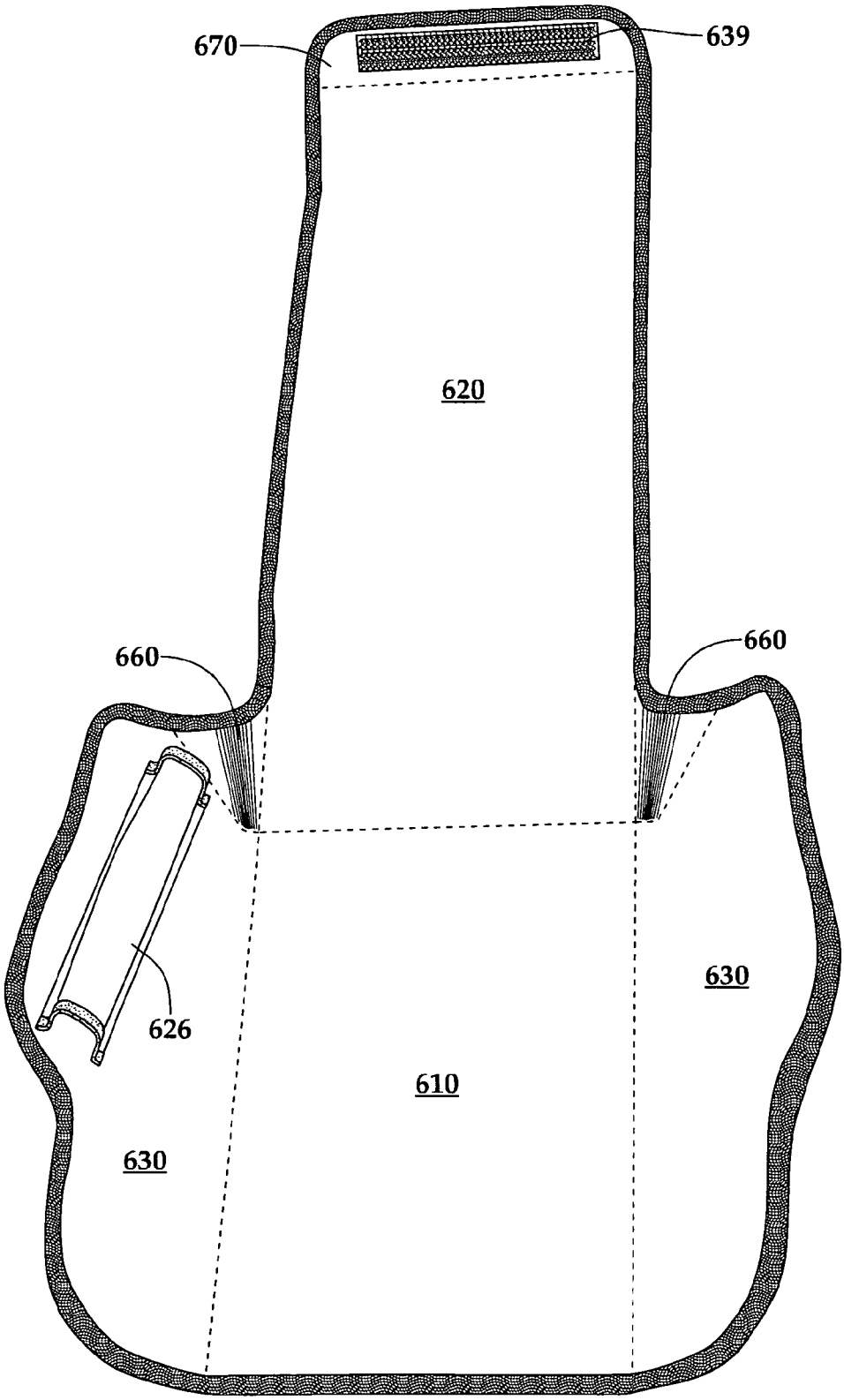
FIG. 14 is a perspective view of the inside of the convertible container of FIG. 11 in the activity mat configuration.
Figure 15:
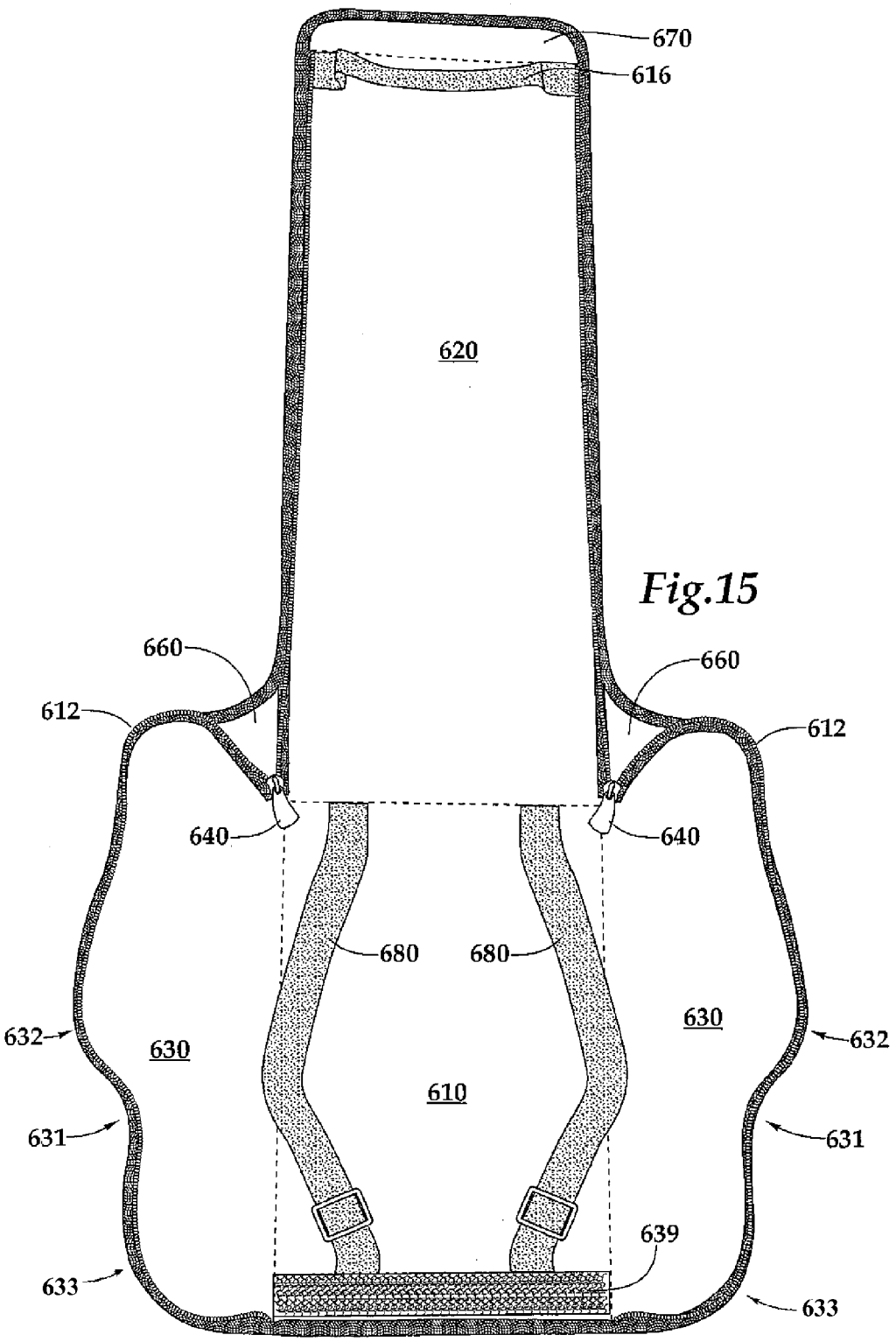
FIG. 15 is a perspective view of the outside of the convertible container of FIG. 11 in the activity mat configuration.

Referring to FIGS. 14-15, the zipper teeth 612 on the side portions 630 follow a generally curved path comprising a first positively oriented curved path portion 631, a second negatively oriented curved path portion 632, and a third negatively oriented curved path portion 633. The positively oriented curved path portion 631 is a counterclockwise direction and the negatively oriented curved path portions 632, 633 are a clockwise direction. It is contemplated that in certain embodiments, the convertible container 600 can have one or more changes between the positively oriented curved path portions 631 and the negatively curved path portions 632.

Figures 16A, 16B:
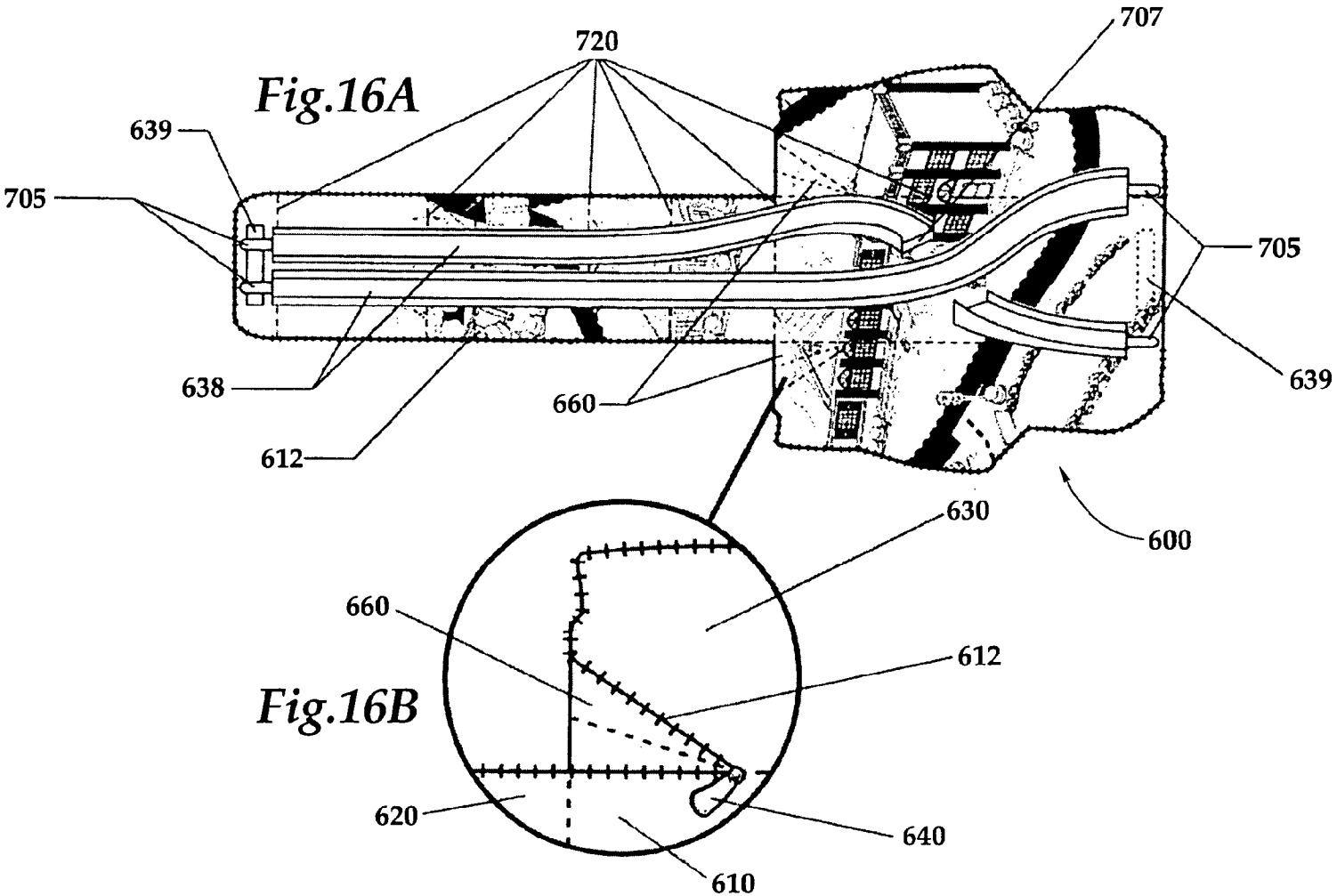
FIG. 16A is a top view of the inside of the convertible container of FIG. 11 in the activity mat configuration including an optional track.
FIG. 16B is a zoomed in view of the baffle shown in FIG. 16A.

The convertible container 600 also includes two baffles 660, shown in FIGS. 14-16. The baffles 660 are configured to connect the base portion 610, the two side portions 630, and the lid flap portion 620. The two baffles 660 are biased inwardly toward the interior of the convertible container 600 to aid in transforming the convertible container 600 from the activity mat configuration to the storage configuration. The two baffles 660 can include a semi-rigid material that is scored or pre-folded to form an inward bias of the baffles 660. The baffles 660 also prevent abrupt notches in the activity mat that prevent the activity mat from lying flat and also present a contiguously shaped form to the activity mat. For example, without the baffles 660, an abrupt notch (see FIG. 16B), would be created and the activity mat would not lie flat in the notched area.

The convertible container 600 includes a closure flap portion 670. The closure flap portion 670 is similar to the overlapping described above in relation to the convertible container 100. The closure flap portion 670 is adapted to mate with an exterior portion of the base portion 610 to close the top of the convertible container 600 when in the storage container configuration. The closure flap portion 670 is helpful to prevent items stored within the container 600 from falling out during transport. It is contemplated that the closure flap portion 670 may be detachably sealed by a hook and loop fasteners 639, as shown in FIGS. 14-15 (e.g. Velcro) or by a zippered system shown in FIGS. 12-13.

The convertible container 600 can optionally include one or more shoulder straps 680. The straps 680 make it easier for a person to wear the convertible container in the storage container configuration as a back pack. The straps 680 are connected to an exterior portion of the base portion 610. The straps 680 can be made of any material including, but not limited to, cotton, canvas, hemp, nylon, polyester, or similar materials or combinations thereof.

Figure 17:
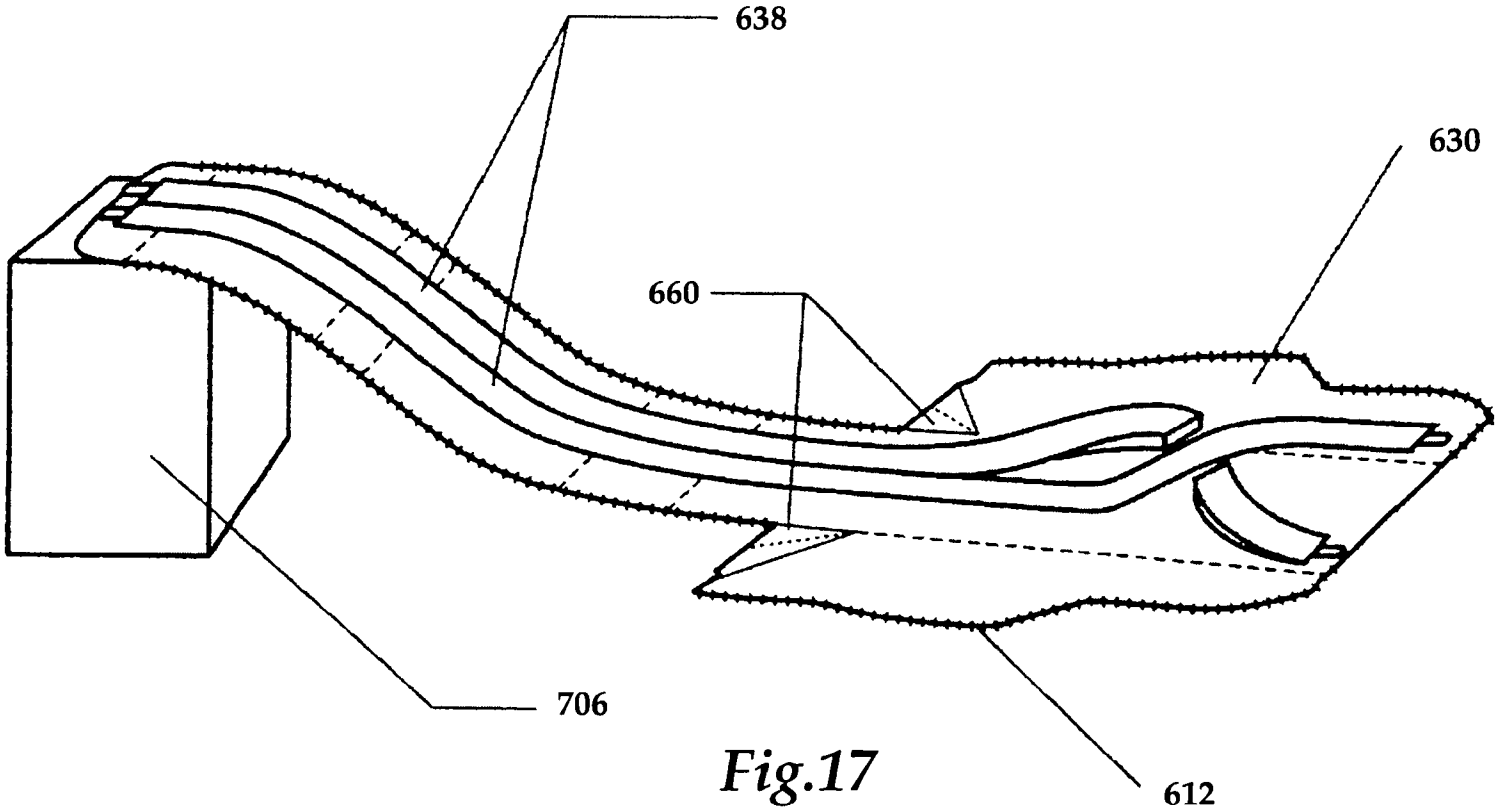
FIG. 17 is a perspective view of the convertible container of FIG. 11 in the activity mat configuration having a portion of the activity mat in a raised position.

The convertible container 600 can include a raised track 638 for playing with toy cars, as shown in FIG. 16-17. It is contemplated that the convertible container 600 can be adapted to connect with additional tracks and/or additional convertible containers to extend the length of the raised track 638 to increase the level of fun and excitement for the user and enhance the functionality of the convertible container 600. The convertible container 600 may also include a plurality of pockets 626 formed on the base portion 610, on one or both of the two side portions 630, or on the lid flap portion 620. The convertible container 600 can include a handle 616 attached to an outer surface of the lid flap portion 620, as shown in FIG. 15.

The convertible container 600, may also be called a back pack convertible into an activity mat, can take various shapes. This includes the general shape of the car, as shown in FIGS. 11-13, and also includes the shape of a train, a tractor, a school a bus, a fire truck, fairy wings, a train, a doll house and any shape that appeals to the user.

Figure 11:
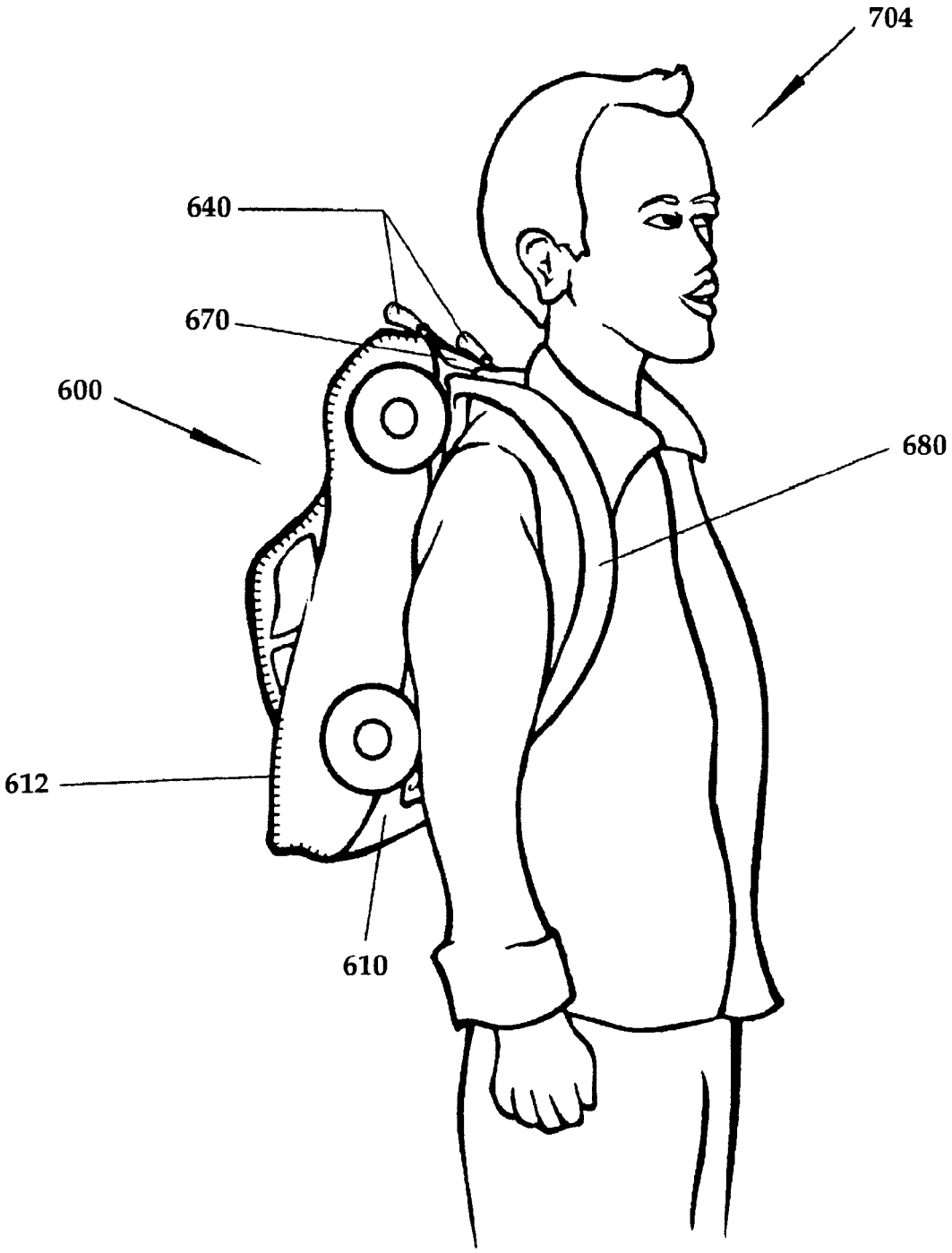
FIG. 11 is a perspective view of a convertible container in a back pack configuration on the back of a human.

FIG. 11 shows a person 704 wearing the convertible container 600 as a backpack. Straps 680 hold the base portion 610 of the convertible container 600 to the person 704. Zipper teeth 612 extend the length of the convertible container 600. The Zipper pulls 640 are shown at the top of the convertible container and the closure flap portion 670 is secured to the base portion 610 as described above.

Figure 12:
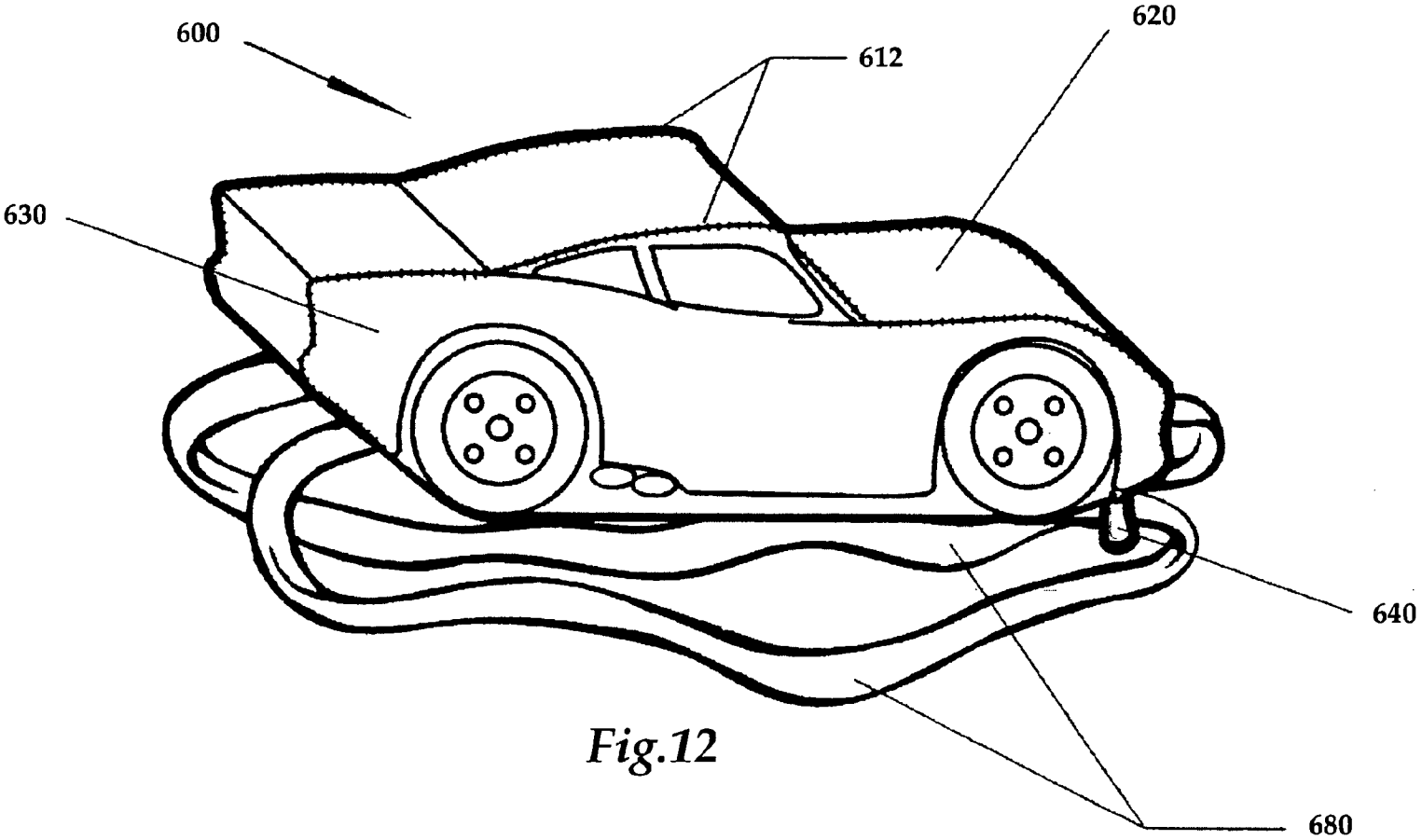
FIG. 12 is a perspective view of the convertible container of FIG. 11.

FIG. 12 shows a side view of the convertible container 600 in its storage container configuration and its various components including the lid flap portion 620, the two side portions 630, the straps 680, the zipper teeth 612, and the zipper pulls 640.

Figure 13:
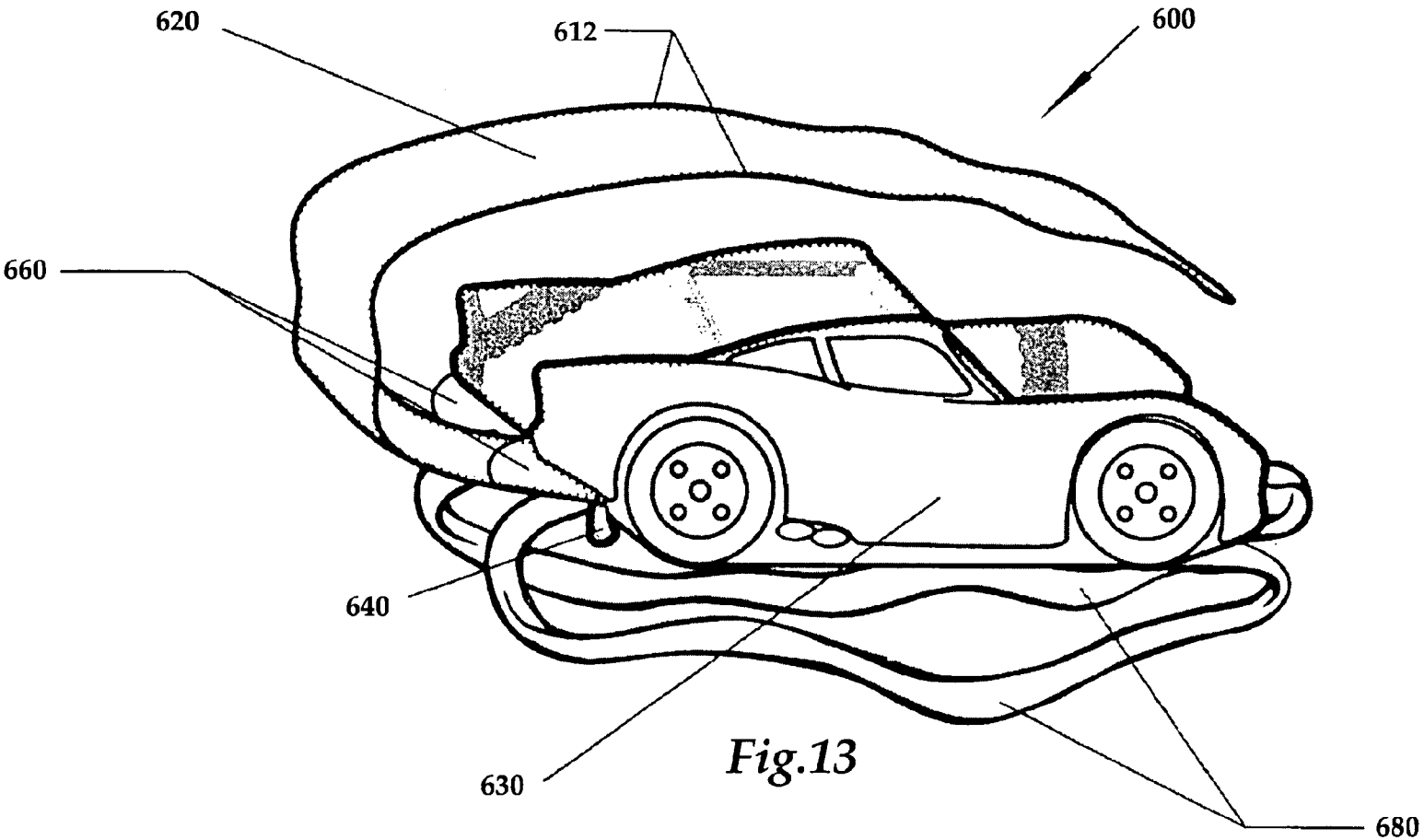
FIG. 13 is a perspective view of the convertible container of FIG. 11 having the lid flap portion partially open.

FIG. 13 shows the convertible container 600 with the lid flap portion 620 unzipped and in a partially opening configuration. The zipper teeth 612 are shown extending the length of the lid flap 620 and the zipper pulls 640 can be seen at the bottom of the convertible container 600. The baffles 660, described above, can be seen connecting the lip flap 620 to the two side portions 630. Themed designs can be seen on the inside surface of one of the sides 630.

FIG. 16*a* shows the a top view of the activity mat configuration that is the inside surface of the fully unzipped and open convertible container 600. The zipper pulls 640 cannot be seen as they are tucked under the baffles 660. The fold lines 720 are shown in their various positions on the activity mat. Tracks 638 for racing toy cars can be seen on the surface of the activity mat. The tracks 638 and the jump 707 enhance the fun and functionality of this activity mat, which is themed as a race track. Connectors 705 allow these tracks to be connected to other tracks or other activity mats to extend the racing experience. The hook and loop fastener 639 is shown on the inside surface of the activity mat and the mating part of the hook and loop fastener 639 is on the opposite end and on the outside of the base portion 610. The track edges can be made of a raised plastic flap, fabric ridge, piping, or a padded bead of fabric or other method known in the art.

FIG. 16B shows the outside view of the baffles 660. The relationship between the zipper teeth 612, the zipper pulls 640, lid flap portion 620, the base portion 610 and the two side portions 630 can be seen. When the zipper pulls 640 are pulled, the two side portions 630 become connected to the base portion 610 and the lid flap portion 620 and the baffles 660 fold inward during the process. In this way, as the zipper teeth 612 become connected by the action of the zipper pulls 640, the activity mat takes the shape of the race car as shown in FIG. 12.

FIG. 17 shows the convertible container 600 in the activity mat configuration positioned in a similar way as convertible container 100 in FIG. 3. Similarly, FIG. 17 shows one end of the convertible container 600 raised on an external elevation block 706 which makes the tracks 638 more fun and interesting to play with.

Figure 18:
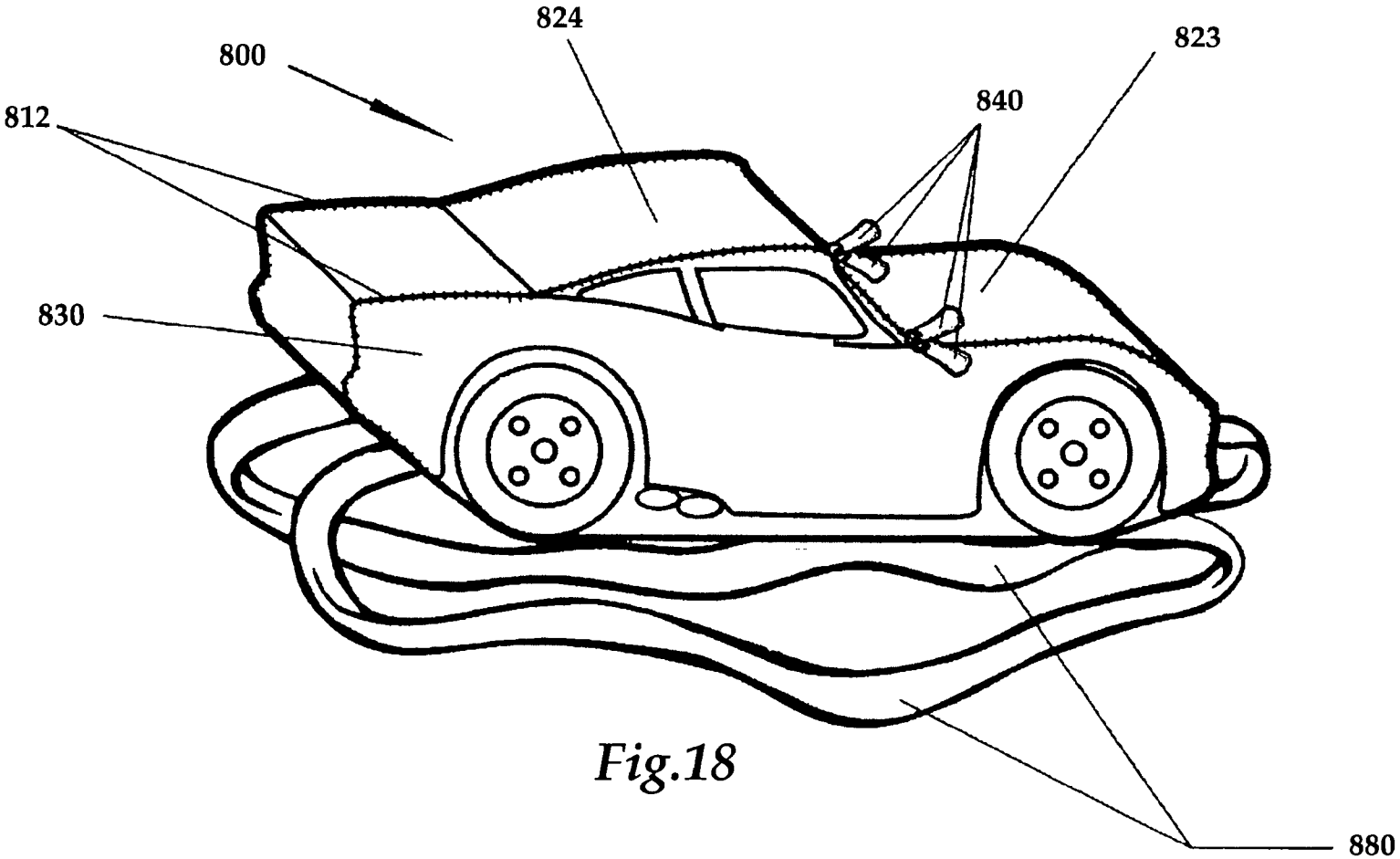
FIG. 18 is a perspective view of a convertible container in a back pack configuration according to certain embodiments of the present disclosure.

FIG. 18 shows a configuration of a convertible container 800 in a storage container configuration, also shown called a backpack configuration. The convertible container 800 includes a base portion 810, two side portions 830, an upper top flap portion 823, a lower top flap portion 824 and four zipper pulls 840. Zipper teeth 812 are shown running along the length of both side portions 830 of the convertible container 800. the convertible container 800 can also include straps 860 as shown in FIG. 18.

Figure 19:
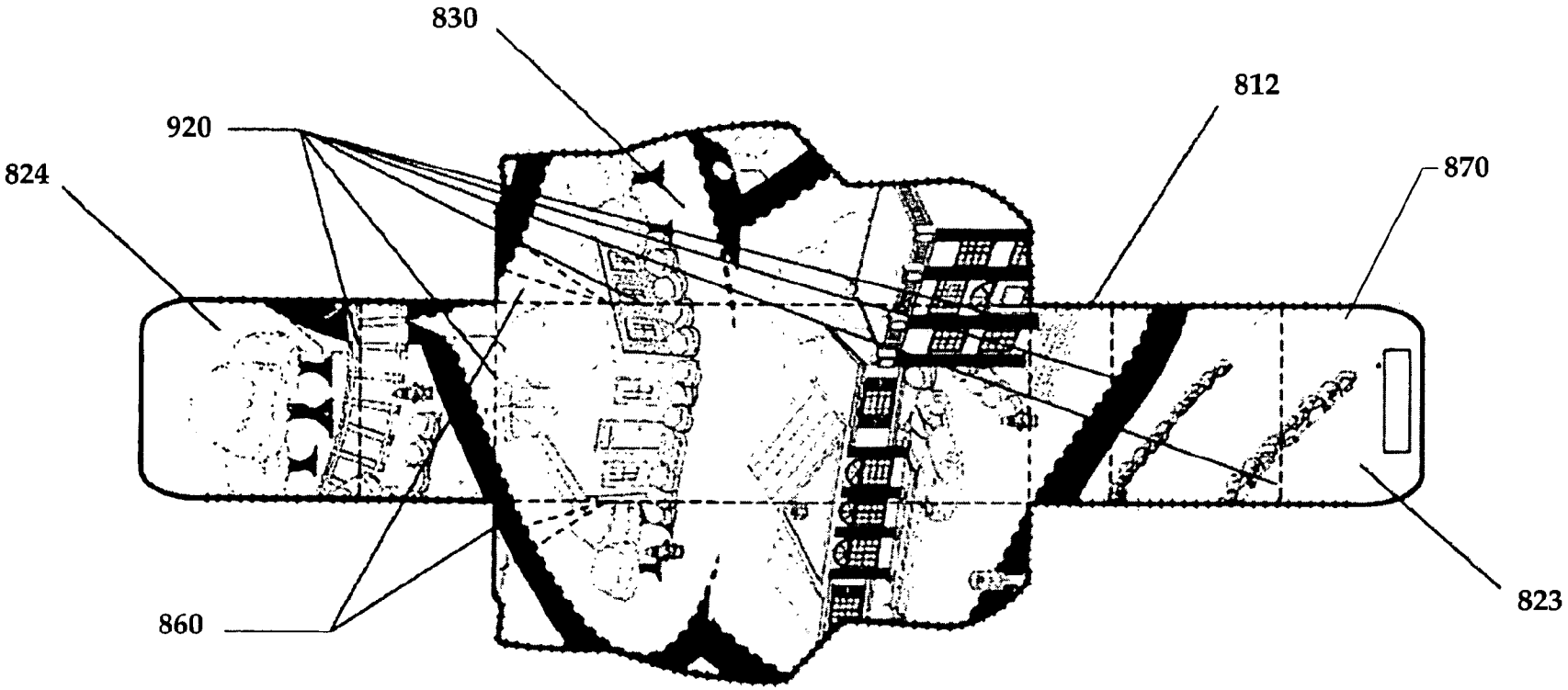
FIG. 19 is a top view of the convertible container of FIG. 18 in the activity mat configuration.

FIG. 19 shows the activity mat configuration of the convertible container 800 having the two flap convertible construction described above. The fold lines 920 are shown by doted lines. A closure flap 870 is also shown in this view.

Figure 20:
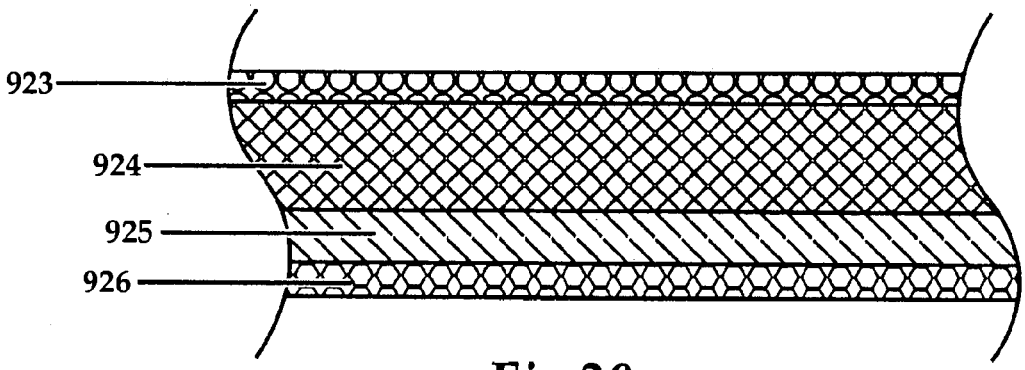
FIG. 20 is a cross-sectional view of various components that form portions of the convertible containers according to certain embodiments of the present disclosure.

FIG. 20 shows a partial cross section showing alternative construction of the wall 130, 230, 330; and/or the lid 110, 210, 310; and/or the base 120, 220, 320; and/or the side portions 630,830; and/or the base portion 610,810 according to certain embodiments. While these portions can be made of fabric alone, adding rigid or semi-rigid structural members to these portions provides the convertible containers 100, 200, 300, 600, and 800 with more body, shape-holding and can additionally provide padding. According to certain embodiments, this view shows the construction of an outer surface material 923, an inner surface material 926, a stiffening member 925, and a padding member 924. The outer surface material 923 and the inner surface material 926 can be made of the same or different fabrics or plastic films. The optional stiffening member 925 includes a semi-rigid material composed of cardboard, paperboard, plastic, foam or other material known in the art. The further optional padding member 924 includes material composed of foam, wadding, or other materials known in the art.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. An apparatus convertible between at least a storage container in a first configuration and an activity mat in a second configuration, comprising:

a base portion;

at least two side portions connected to the base portion, each of the two sides having first zipper teeth;

a lid flap portion connected to the base adjacent the at least two side portions, the lid flap portion having second zipper teeth; and at least two zipper pulls configured to zip and unzip the lid flap portion to and from the at least two side portions such that when the lid flap portion is substantially zippered to the at least two sides, the apparatus is in the first configuration, wherein the first zipper teeth follow a generally curved path comprising a first curved path portion, a second curved path portion, and a third curved path portion, the second curved path portion being curved in a direction opposite of a direction of the first and the third curved path portions, in response to the apparatus being converted from the second configuration to the first configuration, at least a portion of the first curved path portion is located about a first axis passing through the apparatus, at least a portion of the second curved path portion is located about a second axis remote from the apparatus, and at least a portion of the third curved path portion is located about a third axis passing through the apparatus.

2. The apparatus of claim 1, further comprising at least two baffles configured to connect the base portion, the at least two side portions, and the lid flap portion, the at least two baffles biased inwardly such that when the at least two side portions are urged from the second configuration to the first configuration the at least two baffles fold toward the interior of the apparatus.

3. The apparatus of claim 1, further comprising a closure flap portion adapted to mate with an exterior portion of the base portion.

4. The apparatus of claim 3, wherein the closure flap portion mates with the exterior portion of the base portion using hook and loop fasteners.

5. The apparatus of claim 1, further comprising at least one shoulder strap connected to an exterior portion of the base portion.

6. The apparatus of claim 2, wherein the at least two baffles include a semi-rigid material that is scored or pre-folded so as to form an inward bias.

7. The apparatus of claim 1, wherein the at least two sides are generally symmetrical.

8. The apparatus of claim 1, wherein the direction of each of the first and the third curved path portions is a counterclockwise direction and the direction of the second curved path portion is a clockwise direction.

9. The apparatus of claim 1, further comprising a raised track for playing with toy cars.

10. The apparatus of claim 1, further comprising a plurality of pockets formed on at least one of the base portion, the at least two side portions, or the lid flap portion.

* * * * *